US010311681B2

(12) United States Patent
Litman

(10) Patent No.: US 10,311,681 B2
(45) Date of Patent: Jun. 4, 2019

(54) ELECTRONIC TABLE GAME PLATFORM WITH SECONDARY RANDOM EVENT DISPLAYS

(71) Applicant: Mark A. Litman, Edina, MN (US)

(72) Inventor: Mark A. Litman, Edina, MN (US)

( * ) Notice: Subject to any disclaimer, the term of this patent is extended or adjusted under 35 U.S.C. 154(b) by 0 days.

(21) Appl. No.: 15/990,726

(22) Filed: May 28, 2018

(65) Prior Publication Data

US 2018/0276951 A1 Sep. 27, 2018

Related U.S. Application Data

(63) Continuation-in-part of application No. 15/376,841, filed on Dec. 13, 2016, now Pat. No. 9,997,013, and a continuation-in-part of application No. 14/829,800, filed on Aug. 19, 2015, now Pat. No. 10,134,235.

(51) Int. Cl.

| | |
|---|---|
| ***A63F 1/00*** | (2006.01) |
| ***A63F 3/00*** | (2006.01) |
| ***G07F 17/32*** | (2006.01) |

(52) U.S. Cl.

CPC ..... *G07F 17/3293* (2013.01); *A63F 1/00* (2013.01); *A63F 3/00157* (2013.01); *G07F 17/322* (2013.01); *G07F 17/3244* (2013.01); *G07F 17/3258* (2013.01); *A63F 2001/001* (2013.01); *A63F 2001/003* (2013.01); *A63F 2003/00164* (2013.01)

(58) Field of Classification Search

CPC ..... A63F 1/00; A63F 2001/001; A63F 2001/003; A63F 2003/00164; A63F 3/00157; G07F 17/322; G07F 17/3244; G07F 17/3258; G07F 17/3293

See application file for complete search history.

(56) References Cited

U.S. PATENT DOCUMENTS

| | | | | |
|---|---|---|---|---|
| 5,743,800 | A * | 4/1998 | Huard | A63F 3/00157 463/12 |
| 6,117,009 | A | 9/2000 | Yoseloff | |
| 6,152,822 | A * | 11/2000 | Herbert | G07F 17/32 463/16 |
| 6,159,096 | A | 12/2000 | Yoseloff | |
| 6,688,979 | B2 | 2/2004 | Soltys | |
| 6,712,696 | B2 | 3/2004 | Soltys | |
| 6,758,751 | B2 | 7/2004 | Soltys | |

(Continued)

*Primary Examiner* — William H McCulloch, Jr.

(74) *Attorney, Agent, or Firm* — Mark A. Litman & Associates, P.A.

(57) ABSTRACT

A gaming system for enabling enhancement of wagering outcomes includes: a) multiple gaming sites having a game play surface with a light display element on the game play surface at a player position; b) a processor; c) a player input control at the player position, the player input control in communication with the processor; and d) a random number generator in communication with the processor. The light display on the game play surface at the player hand position has lights, and a power source in communication with the lights; the processor, in response to random selections for the light display element at the player position, is configured to direct that the lights at the player hand position are randomly lit. Lights may also be present at a dealer hand position. The lights indicate at least one of an immediate award, multiplier or bonus event, including a progressive jackpot.

20 Claims, 9 Drawing Sheets

(56) References Cited

U.S. PATENT DOCUMENTS 6,857,961 B2 2/2005 Soltys
6,964,612 B2 11/2005 Soltys
6,991,544 B2 1/2006 Soltys
7,011,309 B2 3/2006 Soltys
7,222,852 B2 5/2007 Soltys
7,317,615 B2 1/2008 Chang et al.
7,390,256 B2 6/2008 Soltys
7,427,234 B2 9/2008 Soltys
7,510,194 B2 3/2009 Soltys
7,575,234 B2 8/2009 Soltys
7,758,411 B2 7/2010 Crawford, III et al.
8,109,821 B2 2/2012 Kovacs
8,147,316 B2 4/2012 Arezina et al.
8,348,747 B2 1/2013 Arezina et al.
8,403,740 B2 3/2013 Kovacs
8,613,650 B2 12/2013 Kovacs
8,915,786 B2 12/2014 Baerlocher
8,926,421 B2 1/2015 Arezina et al.
9,997,013 B2 * 6/2018 Litman ..... A63F 1/00
10,134,235 B2 * 11/2018 Litman ..... A63F 1/18
2002/0074726 A1 * 6/2002 Yoseloff ..... G07F 17/32 273/274
2003/0008769 A1 1/2003 Garoff et al.
2006/0189365 A1 * 8/2006 Crawford, III ..... G07F 17/32 463/13
2007/0057462 A1 * 3/2007 Fleckenstein ..... A63F 1/00 273/274
2007/0117604 A1 * 5/2007 Hill ..... G07F 17/32 463/16
2009/0189351 A1 * 7/2009 Baerlocher ..... G07F 17/32 273/309
2010/0019449 A1 1/2010 Downs
2010/0130280 A1 5/2010 Arezina
2011/0275432 A1 11/2011 Lutnick
2012/0010090 A1 1/2012 Nakamura et al.
2012/0157193 A1 6/2012 Arezina
2013/0014364 A1 1/2013 Stillwagon
2013/0217455 A1 * 8/2013 Kennedy ..... G07F 17/3293 463/11
2014/0113712 A1 * 4/2014 Van Asdale ..... A63F 9/24 463/27
2014/0248932 A1 * 9/2014 Rudd ..... G07F 17/3293 463/12
2014/0309017 A1 10/2014 LaDuca
2014/0349726 A1 11/2014 Buchholz
2014/0370980 A1 * 12/2014 Czyzewski ..... G07F 17/3211 463/31
2015/0087417 A1 3/2015 George
2017/0140604 A1 * 5/2017 Litman ..... A63F 1/00
2017/0249801 A1 * 8/2017 Malek ..... G07F 17/3211
2017/0278341 A1 * 9/2017 Moore ..... G07F 17/32
2017/0323530 A1 * 11/2017 Hemberger ..... A63F 1/00
2018/0276951 A1 * 9/2018 Litman ..... G07F 17/3293

* cited by examiner

250

| 252a | 252b | 252c |
|---|---|---|
| ACE OF SPADES | 2 OF SPADES | 3 OF SPADES |
| 0 | Φ 254b | 0 |
| Φ 254a | 0 | 0 |
| 0 | 0 | Φ 254c |
| 0 | 0 | 0 |

FIG. 2

ELECTRONIC TABLE GAME PLATFORM WITH SECONDARY RANDOM EVENT DISPLAYS

RELATED APPLICATION DATA

Without yet claiming priority from the following applications, which are incorporated by reference in their entirety, the present invention relates to a system and method of improving on aspects of the gaming technology disclosed by the Inventor in:

PROVISIONAL APPLICATIONS: SIDE BETS FOR BLACKJACK WITH OPTIONAL PROGRESSIVE EVENT; 62/160,136; 12 May 2015. SIDE BETS FOR BLACKJACK OR BACCARAT WITH OPTIONAL PROGRESSIVE EVENT; 62/172,266; 16 Jun. 2015; and SIDE BETS FOR BLACKJACK OR BACCARAT WITH PROGRESSIVE EVENT; 23 Jun. 2015; 23 Jun. 2015.

NON-PROVISIONAL APPLICATIONS: SIDE BETS FOR BLACKJACK OR BACCARAT WITH OPTIONAL PROGRESSIVE EVENT; Ser. No. 14/789,995; 2 Jul. 2015; and SIDE BETS FOR PLAYING CARD WAGERING EVENTS WITH OPTIONAL PROGRESSIVE EVENT; Ser. No. 14/805,863; 22 Jul. 2015; and SIDE BETS FOR PLAYING CARD WAGERING EVENTS WITH OPTIONAL PROGRESSIVE EVENT; Ser. No. 14/829,800, filed 19 Aug. 2015. This Application claims priority under 35 USC 120 as a continuation-in-part of U.S. patent application Ser. No. 15/376,841, filed 13 Dec. 2016, and titled NOVEL GAMING TABLE, NOVEL EVENT GENERATOR AND METHOD, and also claims priority under 35 USC 120 as a continuation-in-part of U.S. patent application Ser. No. 15/829,800, filed 19 Aug. 2015 and titled SIDE BETS FOR BLACKJACK OR BACCARAT WITH PROGRESSIVE EVENT. All the above identified applications and documents cited in the following specification are incorporated herein by reference in their entireties.

BACKGROUND OF THE INVENTION

1. Field of the Invention

The present invention relates to the field of gaming, particularly to the field of card games (both physical and electronic) and particularly to the use of side bets variations in the game of blackjack or baccarat.

2. Background of the Art

The industry has attempted to use side bet and jackpot events to attract players to games and to keep players active in games for extended periods. It has been found to be extremely difficult to develop jackpot games for use with baccarat and blackjack that have a reasonable ability to develop large jackpots (e.g., over 100,000 wagering units, such as US dollars) and to provide a significant hit frequency with less than entire jackpots being awarded. Typically, jackpots identified with blackjack and baccarat games have maximum jackpot hit frequencies in the 1:50,000 range, so that jackpots rarely exceed 50,000 units. Particularly with networked games having many tables, low total jackpots do not attract as much play as jackpots in the 100,000 unit range (that is 100,000 times the amount of the side bet wager) and 500,000 range and even in excess of a million unit range. One reason for the inability of high jackpots to be reached is that all outcomes definable from three or four cards (the initial visible cards in blackjack and baccarat) occur with frequencies below the 1:50,000 range.

Published US Patent Application Document No. 20140309017 (LaDuca) discloses a method of playing a combined casino card game combining a standard casino card game with an optional In Between side bet that uses the same cards as played in the standard casino card game. A player makes an optional In Between side wager that the face value of at least one designated in between card falls in between or equals the face value of two designated end cards according to the "rank order" 2-3-4-5-6-7-8-9-10-J-Q-K-A. The casino card game bet and the optional In Between side bet are separate and do not affect the play of the standard casino card game. Preferred embodiments include the In Between side bet combined with casino Blackjack, Baccarat, and Texas Hold'em.

U.S. Pat. Nos. 8,926,421; 8,348,747; 8,147,316; and 7,758,411 and Published Applications Nos. 20060189365 (PokerTek) describe fully electronic tables with virtual playing cards, electronic wagering and even no live dealer. Multiple players have individual active screens displaying event outcomes and enabling wagers. U.S. Design Pat. No. D512,466 shows a table layout with individual player panels that display individual player cards and provide individual player inputs on wagers and discards.

Published US Patent Application Documents Nos. 20120157193 and 20100130280 (Arezina) describe a multiplayer gaming system that senses multiple simultaneous contacts on a surface of a gaming table, differentiating contacts by different players. Privacy controls selectively display private information visible to only one of the players on or near the display surface of the gaming table. The gaming system also detects physical objects placed on the surface of the gaming table, causing wagering game functions or peripheral functions to be performed as a result of the placement of the object on the display surface.

Other systems emphasize control of playing cards and reading playing card and hand ranks. Published US Patent Application Documents No. 20100019449 (Downs) describes a playing card delivery shoe is used in the play of the casino table card game of baccarat or blackjack or any game where cards are pulled one at a time from the shoe. The apparatus comprises a reader or an imager that scans lines bisecting the image at spaced intervals. The scanning occurs on playing cards in at least the region where suit and rank symbols are provided. The scanner output is a series of voltages that are converted to binary information. This binary information is compared to stored binary information to determine rank and suit. The upper surface of the output end of the shoe contains a partial barrier for cards being scanned. The partial barrier has an elevated surface and limits a size of a pathway so that only one card can be removed at a time. The table surface defines a number of regions such that when the player tracking card is placed in a predefined region, a predetermined function is carried out.

Published US Patent Application Documents No. 20110275432 (Lutnick) describes an apparatus comprising: a machine readable medium having stored thereon a plurality of instructions that when executed causes a computing device to perform a method comprising: receiving a first wager by a first player on an outcome of a first poker game; determining a first set of hold cards for the first poker game; presenting the first set of hold cards to the first player; receiving a second wager by the first player on only the flop of the first poker game, in which the second wager may be won and lost independently of the first wager, in which the second wager includes a wager that the flop will include at least one characteristic; determining the flop of the first poker game; presenting the flop to the first player; determining whether the second wager is a winning wager based on whether the flop includes the characteristic; presenting an indication of whether the second wager is a winning wager; determining whether the first wager is a winning wager; and presenting an indication of whether the first wager is a winning wager. A software application may use an API associated with a pressure sensor to retrieve data from the sensor, e.g., data about the weight of chips placed over the sensor.

Published US Patent Application Documents No. 20150087417 (George) describes a system for use in operating gaming tables within a gaming environment is described herein. The system includes a user computing device including a display device, an imaging device for capturing and transmitting video images of an observation area within the gaming environment, and a system controller coupled to the user computing device and the imaging device. The system controller is configured to receive a live video image including a gaming table, display the live video image within a display area on the display device, and display an event area within the display area overlaying a portion of the gaming table image.

Published US Patent Application Document No. 20140370980 (Czyzewski) describes a gaming assemblies with a playing surface including at least one screen display. A system projects visual light on the screen display. A radiation source illuminates objects placed over the screen display. A radiation sensor senses at least a portion of the objects placed over the screen display. A control circuit utilizes data from the radiation sensor. Methods of operating gaming tables and wagering game systems may include such gaming assemblies. A method of operating the gaming table, includes: projecting with a system an image onto a rear side of a screen display positioned proximate a playing surface of a gaming table to enable viewing of the image on a front side of the screen display; illuminating the rear side of the screen display with radiation from a radiation source located at the rear side of the screen display, wherein the screen display is at least partially translucent to the radiation to enable at least a portion of the radiation to reflect from an object placed proximate the front side of the screen display; receiving the at least a portion of reflected radiation at a radiation sensor; generating digital data corresponding to the portion of reflected radiation received at the radiation sensor; and determining that the object is present on the top side of the screen with a control circuit configured to receive the digital data.

Published US Patent Application Document No. 20140349726 (Bucholz) describes a method for presenting the appearance of altered game outcome. In some embodiments, the operations can include presenting, by an electronic wagering game table, a wagering game including a game piece. The operations can also include determining a result for the wagering game. The operations can also include receiving first player input to move the game piece to reveal the result. The operations can also include presenting, on a display device, movement of the game piece. The operations can also include receiving, by the electronic wagering game table, second player input to alter the movement of the game piece, wherein alteration of the movement of the game piece appears to modify the result for the wagering game. The operations can also include presenting, in response to the second player input, altered movement of the game piece and the result for the wagering game.

A series of U.S. patent with a common inventor of Soltys (including by way of non-limiting examples, U.S. Pat. Nos. 7,575,234; 7,510,194; 7,427,234; 7,390,256; 7,317,615; 7,222,852; 7,011,309; 6,991,544; 6,964,612; 6,857,961; 6,758,751; 6,712,696; and 6,688,979) describes various components and methods attempting to configure and establish a more automated gaming table.

Most gaming machines, card tables, and sports wagering floors are not conducive or accommodating to two or more people gaming, whether they are playing separate games or sharing decision making on a single game, and variations thereof, or sitting together and simultaneously socializing. Even if two or more adjacent seats are found at a card table or at gaming machines, they typically are not prone to be comfortable for long-term socializing, for instance, over the course of an evening or night. This is especially true for casino patrons who are less inclined to gamble and are there with friends or a spouse more for the social aspects and to participate in non-gaming activities (e.g., video and audio entertainment) or simply to watch others gamble. Many current gaming machines and casino floor layouts are poorly suited to address the increasing need to make gaming a more social activity and to enable plyers to compare results and statistics from multiple positions on a shared central display.

Certain known gaming systems display events on a central display screen and/or provide common game content on a single display device for multiple gaming positions and a few such community or multiplayer machines have a central display on which common and/or individual player information can be displayed.

U.S. Pat. No. 8,915,786 (Baerlocher) discloses a plurality of simultaneously, substantially simultaneously or sequentially played primary games, wherein a designated triggering event in at least one of the games causes the gaming device to change, modify, supplement, add to, activate or otherwise influence the paytable of at least another game.

U.S. Pat. Nos. 8,613,650; 8,403,740; and 8,109,821 (Kovacs) provides a gaming system including a central controller, a central display which includes a plurality of display segments and a plurality player stations. The display segments are configured to each separately display one of a plurality of games, to co-act to display a plurality of games, or to co-act to display one game. Each player station is configured to enable a player to play one or more of the games displayed by the display segments. The gaming system enables a plurality of players to play a group game on the central display, a plurality of players to simultaneously play multiple group games on the central display, and a plurality of players to each simultaneously play multiple individual games on the central display.

U.S. Pat. No. 8,333,657 (Nelson) describes a system that changes the focal point of a display device at different points in time to assist the player in focusing on different simultaneously or concurrently played games at different points in time. Specifically, the gaming system displays a plurality of simultaneously or concurrently played games on a display device. In response to a designated event occurring in association with a specific one of the plurality of simultaneously or concurrently played games, the gaming system changes the focal point of the display device to draw the player's focus or attention to that specific one of the simultaneously or concurrently played games. Put differently, the gaming system dynamically allocates and/or indicates different portions of a display device to different simultaneously or concurrently played games at different points in time to account for different events occurring in such simultaneously or concurrently played games.

There are significant limitations in these systems, especially with respect to enabling any deviation from traditional game play. Additionally, it is desirable for the functional ability of the game table to contribute to specialty or carnival wagering games. In particular, these technologies (including those in the Related Applications data section, herein), when providing side bets for progressive jackpots using physical playing cards, may have variations in probabilities of winning outcomes as playing cards are exhausted, enabling some level of card counting to be used to determine advantages in gaming outcomes.

SUMMARY OF THE INVENTION

A gaming system for enabling enhancement of wagering outcomes includes: a) a gaming table having a game play surface; b) a processor; c) a player input control at a player hand position, the player input control in communication with the processor; and d) a random number generator in communication with the processor. The game play surface at the player hand position has lights that are at card-receiving positions at the player position, a power source in communication with the lights; the processor, in response to random selections of the card-receiving positions at the player position, configured to direct that a closed electrical connection occur between the power source and the lights at the player hand position. Lights may also be present at a dealer hand position.

The gaming system may be used in a method and apparatus for hosting a modified game of blackjack or baccarat with a player position in competition with a dealer position. The player position and the banker position receiving playing cards from one or more decks of 52 playing cards, the method comprising: performing a side bet event during a blackjack wagering event according to the present technology includes:

a) a player position providing a side bet wager to be determined by playing cards provided to the dealer hand position and/or the player hand position;
b) providing two random playing cards to a dealer hand position, and providing two random playing cards to a player hand position face up;
c) resolving the side bet wager against a paytable which identifies a spread (number of card ranks available between two cards) in a hand(s) on which the side bet wager has been placed;
d) providing a third random card (or third and fourth random card in baccarat) as either i) a card (or both cards) dealt to the dealer (banker hand in baccarat) hand or ii) using a dealer single up-card (or banker two cards in baccarat) as a side bet event card on which the side bet wager has been placed; and
e) resolving the side bet wager against a paytable on a basis of whether the third (or third and fourth) random card has a rank within the spread and size of the original spread.

By using randomly generated lights to identify rarified playing cards (the functional equivalent in the practice of the present technology of specially marked cards), a side bet progressive game can be constructed in which jackpots statistically can grow to levels above one million dollars, without likelihood of extreme variation in advantages or probabilities because of exhausted "specially marked cards."

BRIEF DESCRIPTION OF THE FIGURES

FIG. 2 shows a panel used on a gaming table to show exhaustion of critical marked cards used in the progressive event.

DETAILED DESCRIPTION OF THE INVENTION

Figure 1:
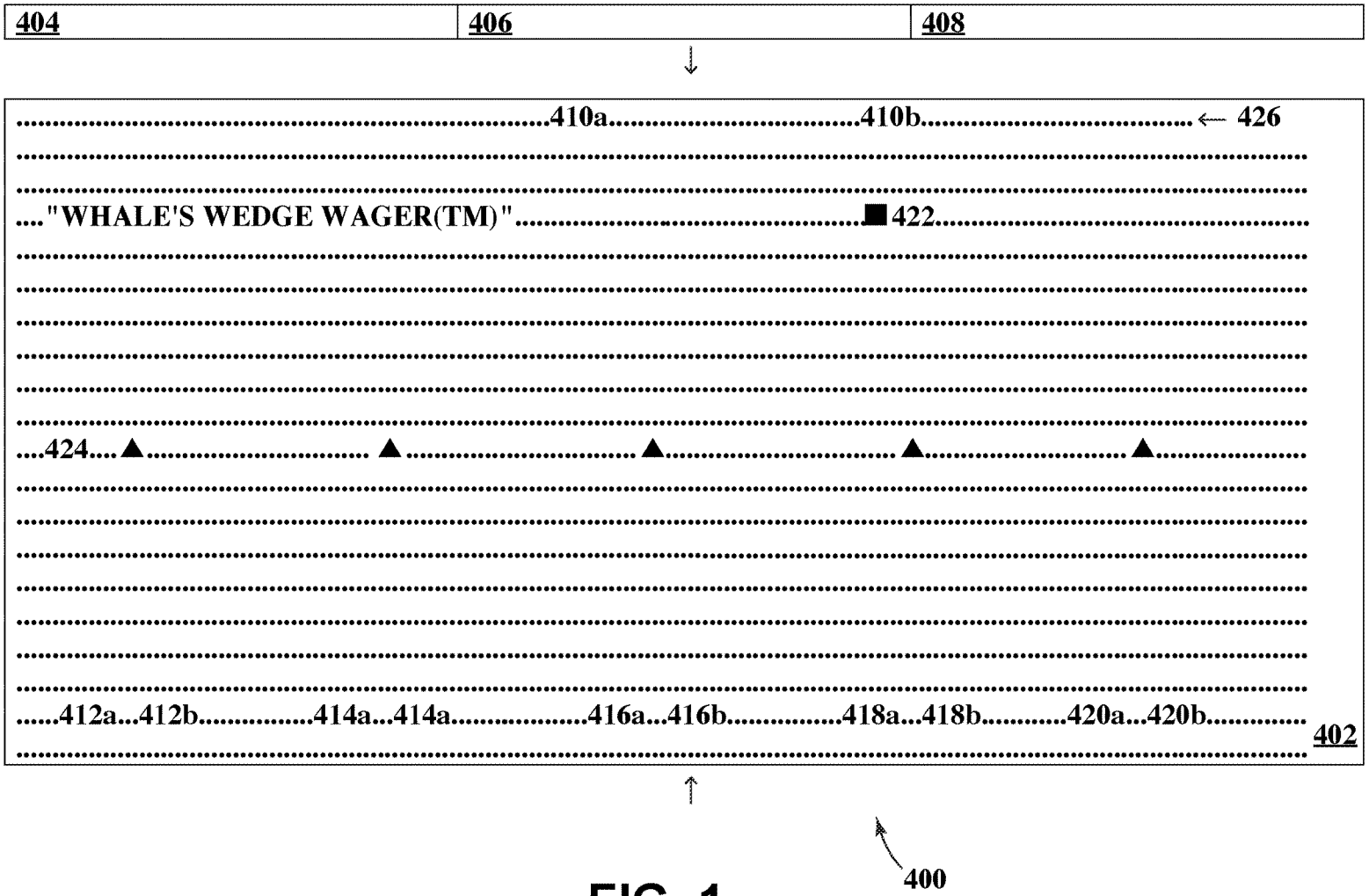
FIG. 1 shows an electronic gaming table on which the gaming method may be executed.
Figure 3:
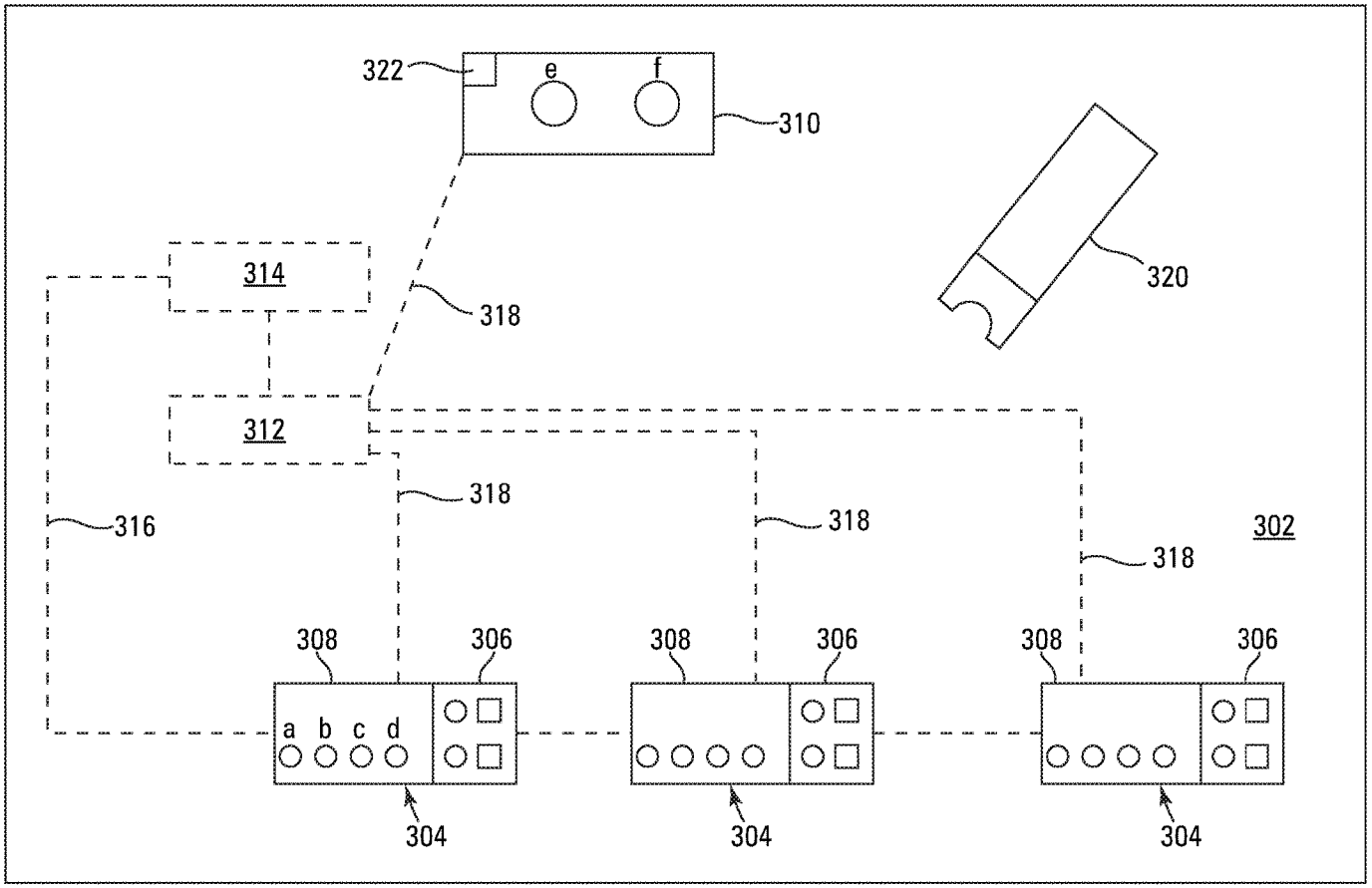
FIG. 3 shows a view of a gaming table useful in the practice of the present technology.
Figure 4:
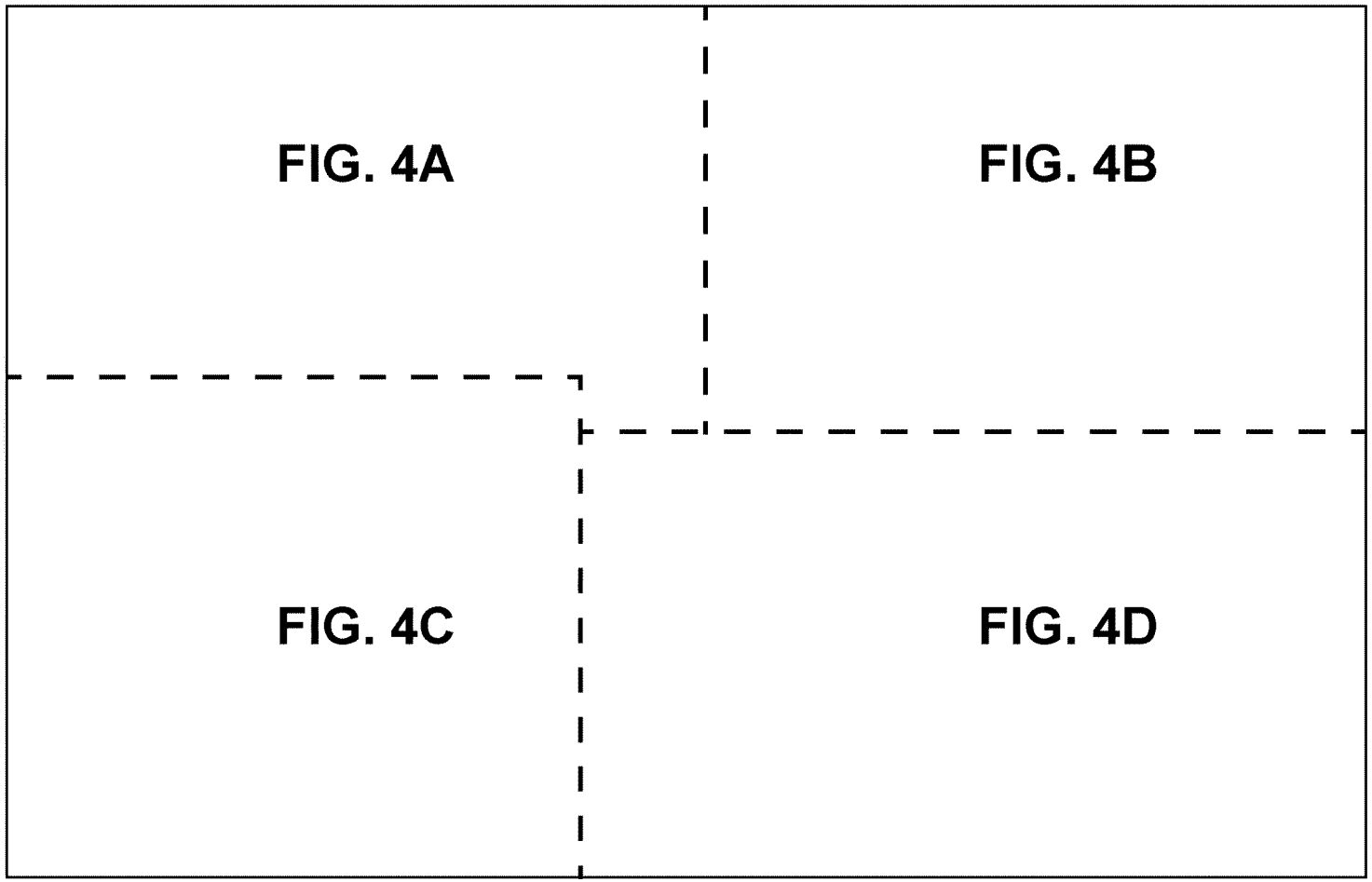
FIG. 4 shows a four-segment template of a schematic of a four channel secondary random event generator of the present technology having quadrant segments 4A, 4B, 4C and 4D.
Figure 4A:
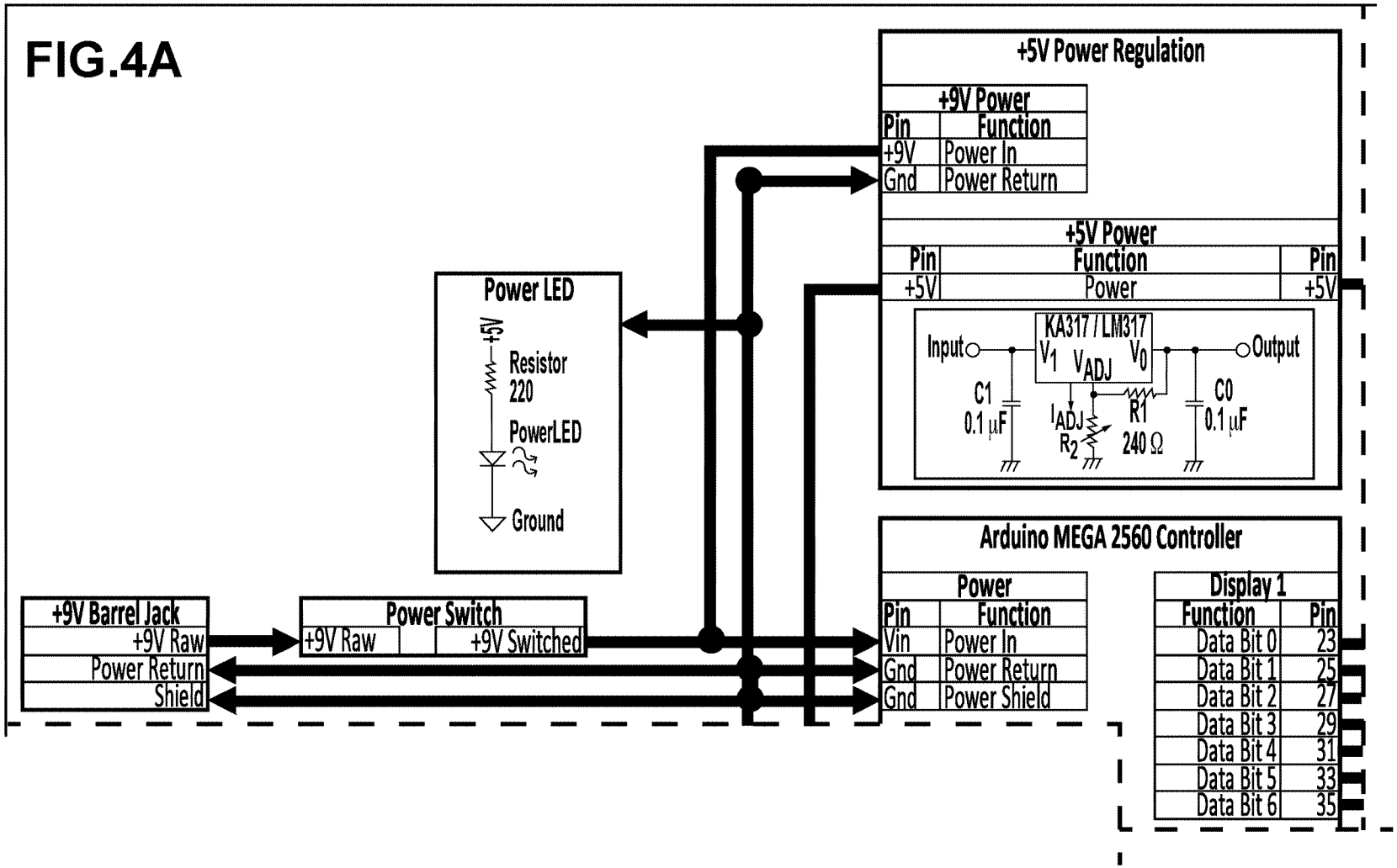
FIG. 4A shows quadrant 4A of the schematic of FIG. 4.
Figure 4B:
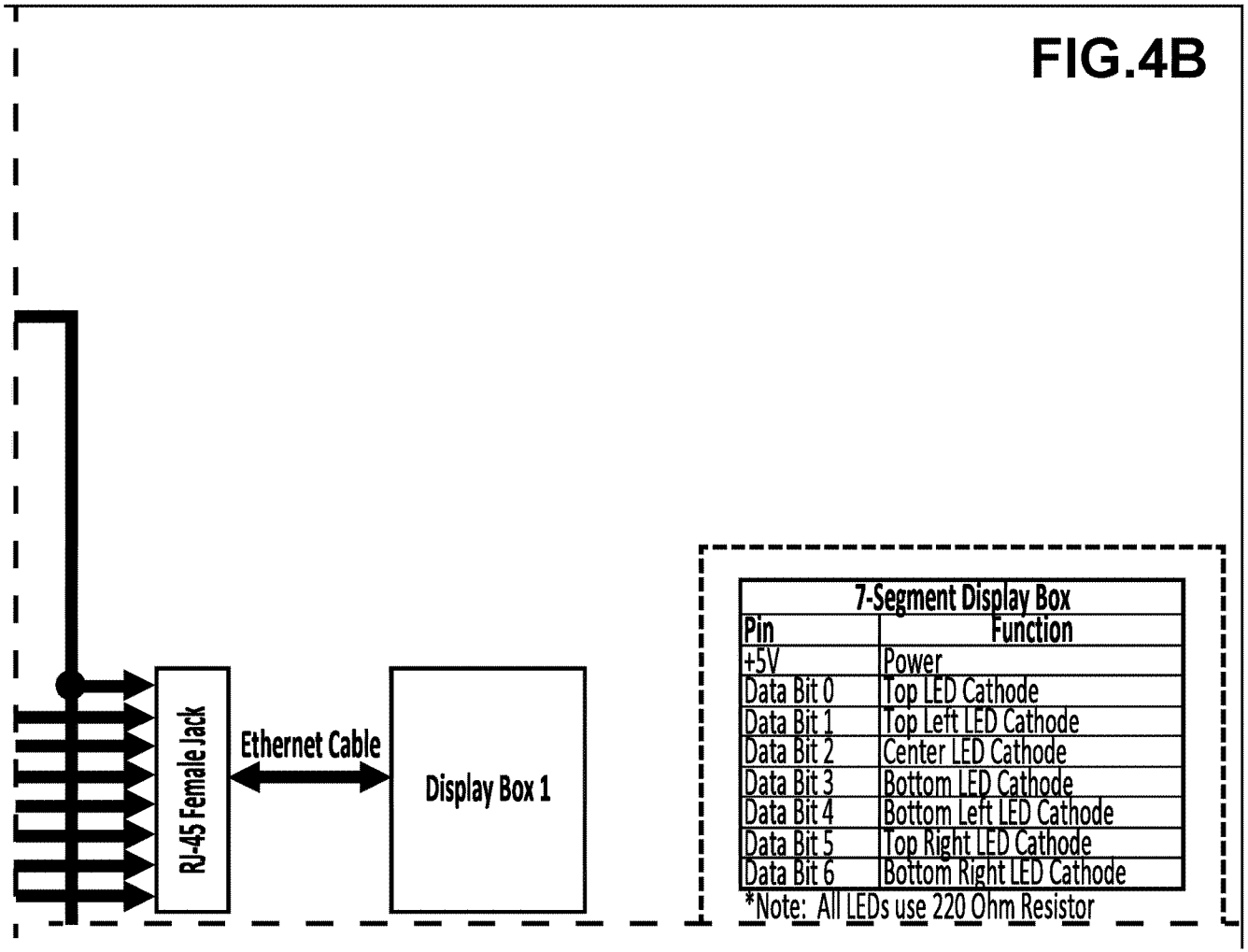
FIG. 4B shows quadrant 4B of the schematic of FIG. 4.
Figure 4C:
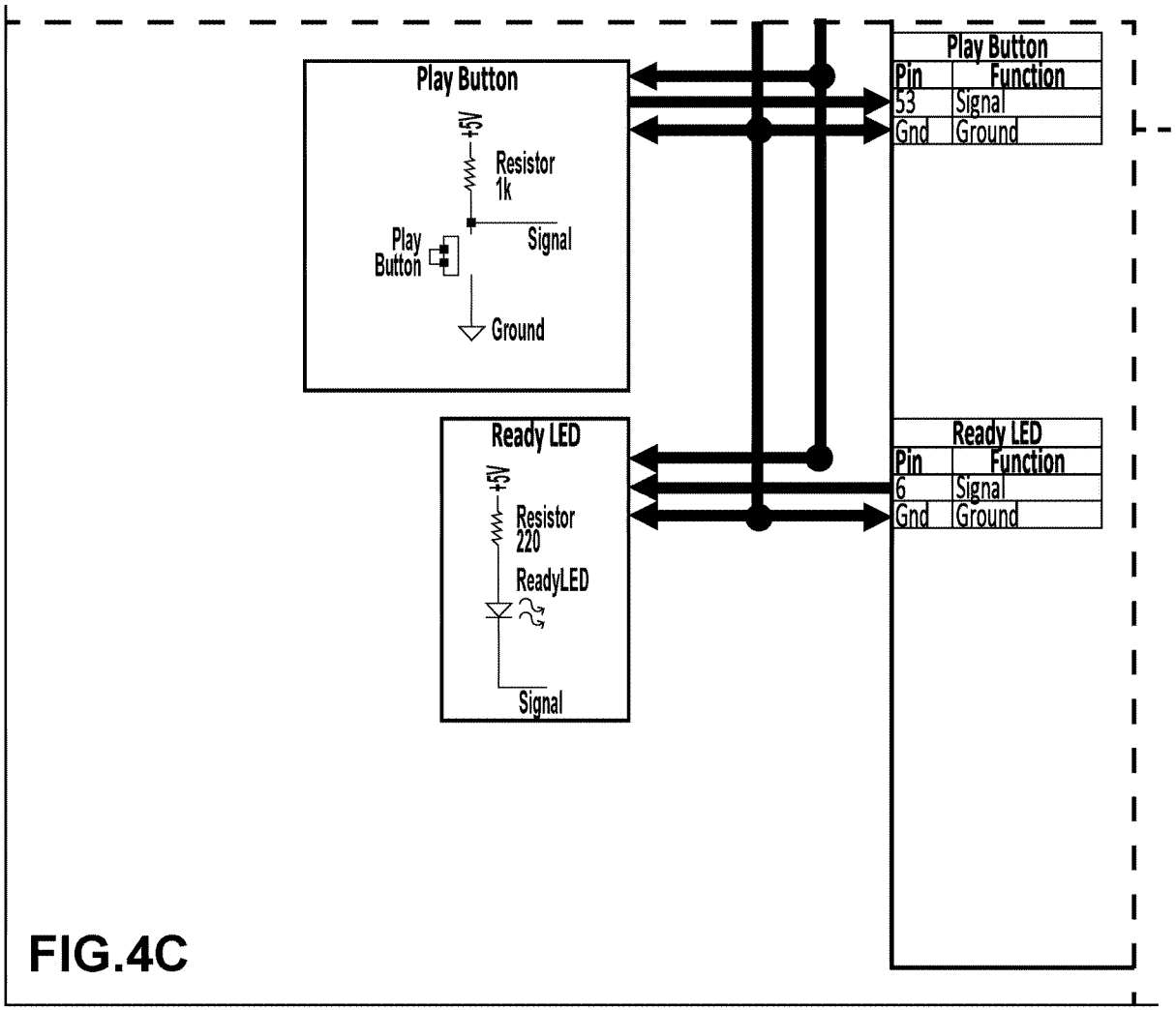
FIG. 4C shows quadrant 4C of the schematic of FIG. 4.
Figure 4D:
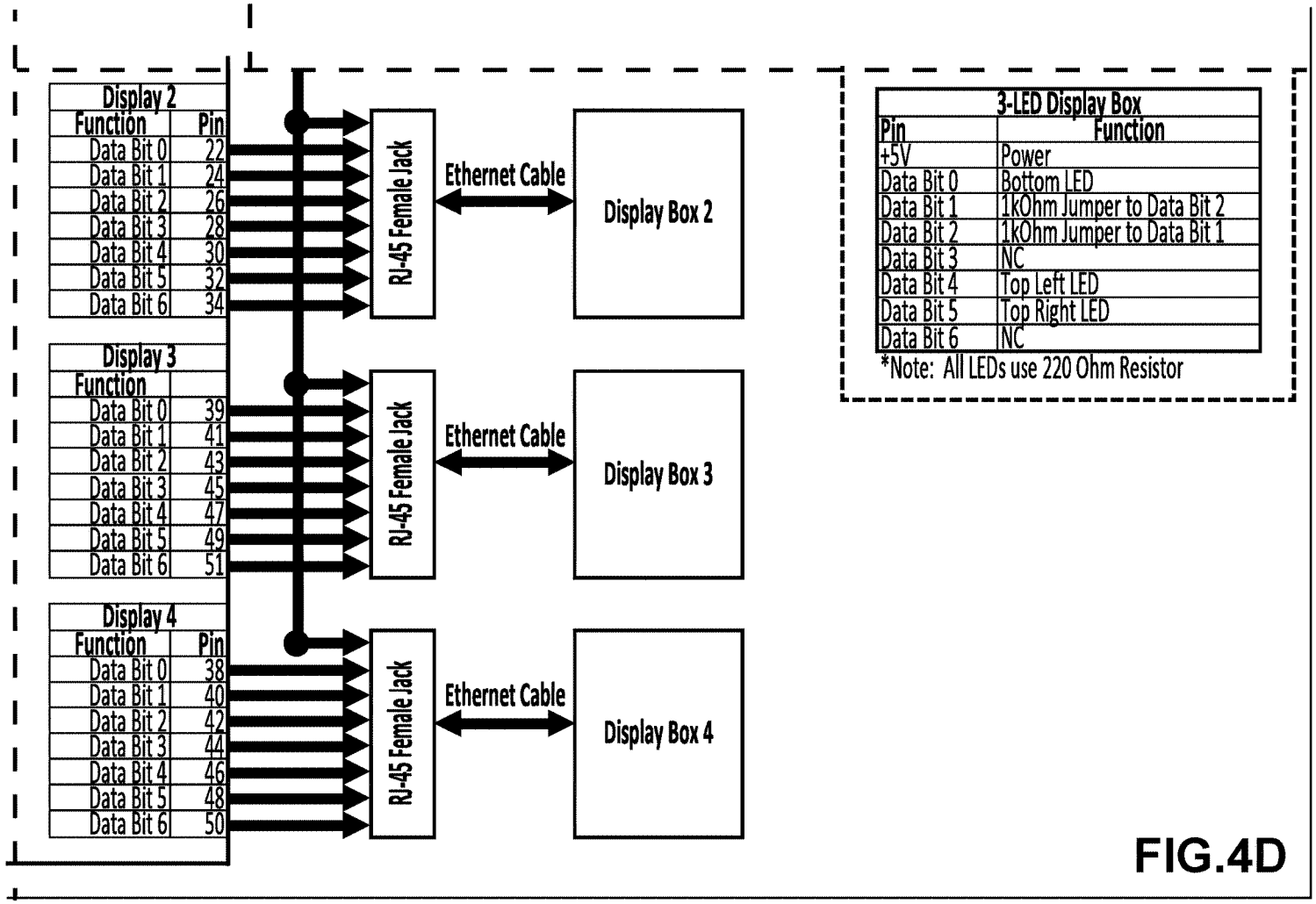
FIG. 4D shows quadrant 4D of the schematic of FIG. 4.
Figure 5:
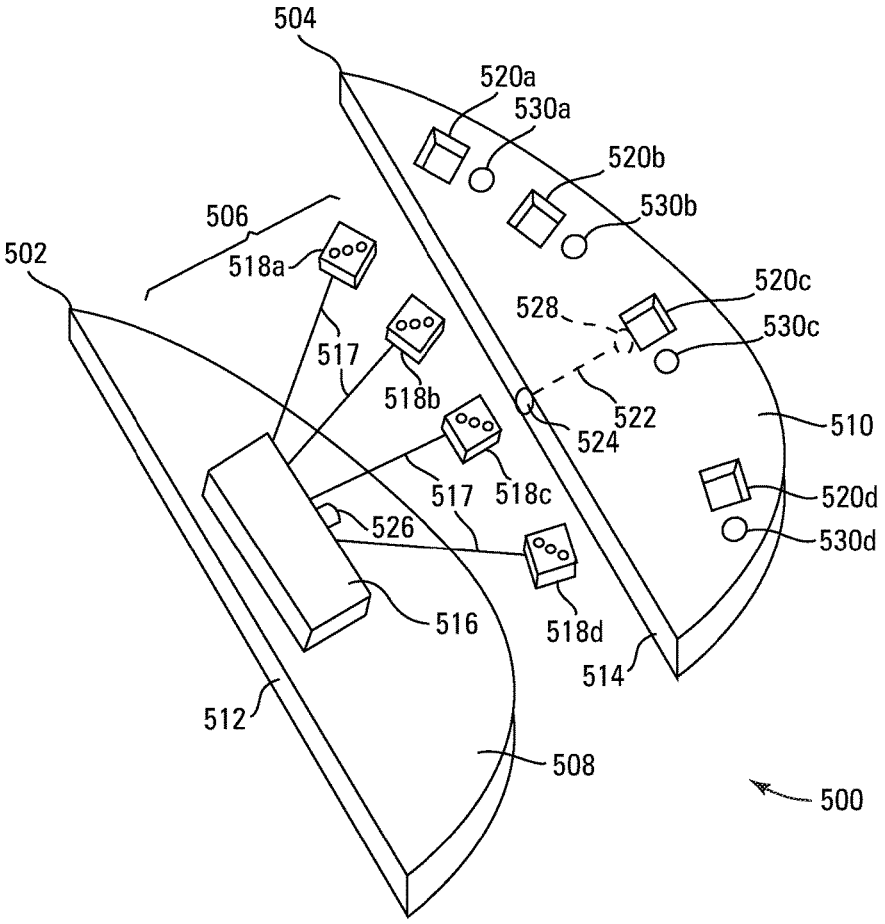
FIG. 5 shows a perspective exploded view of a gaming table including a four-channel secondary random event generator of the present technology.

As noted above, when physical playing cards are used, especially with the use of a limited number of unique playing cards to be used in a jackpot or progressive jackpot event, the unique (such as specially marked playing cards) cards can be observed by players to become exhausted or become richer in remaining cards, which could significantly alter playing strategy and advantages/disadvantages with respect to the progressive jackpot. For example, in a game described herein a 6- or 8-deck shoe of 52-card decks of physical playing cards is used, with, for example, three specific cards (by suit and rank) specifically marked (e.g., Ace of spades, King of spades and Queen of spades are used as a non-limiting example) are used to define a 100% winning outcome for the progressive jackpot. In using physical playing cards to implement the outcome, the specially marked unique playing cards can be observed to become significantly richer or exhausted during play. For example, if there were a single round of play of blackjack with six players at a table, and no specially marked Ace, King or Queen of spades occurred with 22 other cards used in the round of play (including the dealer position cards), the probability of the specially marked cards become at least 5% richer in the remaining set of playing cards, increasing the likelihood of a winning outcome for at least a portion of the progressive jackpot. Similarly, if one, two or three of the specially marked playing cards are displayed in the first round(s), the probability of a 100% jackpot winning event can be decreased by as much as 50% or even completely eliminated (e.g., both Aces of spades where there are only two-each of the specially marked A-K-Q of spades set). Even though a continuous shuffler can be used to dramatically reduce this impact, players may still estimate that replacement cards will not be placed into the front of the remaining set of cards and adjust wagering accordingly. This partial knowledge of distribution is disadvantageous to the operation of the wagering event. The present technology offers apparatus and systems and methods that technically improve the operation of the wagering event and other wagering events where special outcomes are to be evidenced on the gaming table.

A gaming system for enabling enhancement of wagering outcomes is provided with at least: a) a gaming table having a game play surface; b) a processor; c) a player input control at a player position, the player input control being in communication with the processor; and d) a random number generator in communication with the processor. The game play surface at the player position has lights (and optionally a vibrator or audio component for visually-impaired players) that are at card-receiving positions at the player position. A power source in (opened and/or closed) communication with the lights. The processor, in response to random selections of the card-receiving positions at the player position, is configured to direct that a (for example, closed electrical) connection occur between the power source and the lights at the player position so that the lights are randomly lit at at least the player card-receiving position(s)/There may also be lights in communication with the power source at a dealer card-receiving position and the processor, and in response to independent random selections of the card-receiving position at the player position, t processor is configured to direct that a closed electrical connection occur between the power source and the lights at the dealer position. In this way, there is randomly provided lighting at card-receiving positions at player hand positions and dealer hand positions. By using the random lighting at these positions on gaming tables with physical playing cards, the use of actual physically marked or specially marked playing cards can be eliminated. Any one of the unique cards is now provided by the presence of that card in combination with the random lighting at that playing card position. In this manner, with exhaustion of cards in the original set, including the suit and/or rank cards used in a progressive jackpot event (in both blackjack and baccarat, there is a "cut" into the original set so that all cards are never exhausted) are less dramatically diminished or made rich during play. The variation in exhaustion is reduced by at least about 30% (on average) and the variation in richness is reduced by at least about 10% (on average). This gaming system therefore addresses and solves a specific technical issue in gaming technology.

The system also offers a possibility of a separate payout event, either on the underlying wager of the side bet. When one, two, three or four of the playing card positions are randomly lit (with or without the specific ranks of cards used in the preferred progressive playing card jackpot wagering event), an additional payout may be provided, such as 10 wagering units for a single light, 20 wagering units for two lights and 100 wagering units for three or more lights. The term wagering unit is used to identify the amount actually wagered and the units (cents, quarters, dollars, Yuan, Euros, etc.) used as the amount and currency of the wager. The gaming system includes a source of random physical playing cards on the gaming table for delivery of random physical playing cards to the card-receiving positions at the player position and preferably also the dealer position. The gaming system may have the source of random physical playing cards associated with a card-reading component that recognizes at least one of card suit and rank and reports that recognized at least one of suit and rank to the processor for each card-receiving position. The gaming system enables the lights to be controlled between at least an on-off set of conditions (the lights may also be enabled to flash or for unique colors to be provided) e.g., by circuitry which, in effect, gives direction that an effectively closed electrical connection occurs between the power source and the lights at the player position, which may be provided independent of recognition of the at least one of suit and rank delivered to the card-receiving positions, or which is provided dependently on recognition of the at least one of suit and rank delivered to the card-receiving positions, with the random number generator activated upon recognition of physical playing cards at card-receiving positions at the player position with specific at least one of suit and rank. For example, at player card-receiving position No. 1, the random number generator may have a range of probabilities for all cards delivered to that position to be lit at a frequency of between 1:1.1 to 1:25 (as an example of available ranges). At player card-receiving position No. 2, the random number generator may have a range of probabilities for all cards delivered to that position to be lit at a frequency of between 1:1.2 to 1:30 (as an example of available ranges, which do not have to be identical to the range or absolute probability for position No. 1). At dealer card-receiving position No. 1 a, at player card-receiving position No. 1, the random number generator may have a range of probabilities for all cards delivered to that position to be lit at a frequency of between 1:3.1 to 1:35 (as an example of available ranges, again which do not have to be identical to the range or absolute probability for positions No. 1 or No. 2). By varying the mapped probability for each and all positions, the average size of the jackpot, the probability of each potential winning outcome, such as 5%, 10% or 100% of the progressive jackpot, can be controlled for the long-term by the system. As with the use of physically marked special cards (with three positioned cards used, such as A-Q of spades in the player two-card hand and the K of Spades in the single dealer up-card), a frequency of 1:8 for each position would be the equivalent of one set of three specially marked cards and a frequency of 1:4 for each position would be the equivalent of two sets of three specially marked cards. Using different probabilities for each position would be the equivalent of using different numbers of each of the three specially marked cards, but without requiring special marking on the physical playing cards.

A method of performing a side bet wagering event on the gaming system described herein during a playing card wagering event in which any number of random physical playing cards are dealt, and especially where exactly three physical playing cards or exactly four physical playing cards are exposed without any game play strategy or additional cards being provided during play of the playing card wagering event may include:

a) the player position providing a side bet wager to be determined by playing cards provided to at least one of a dealer hand position and the player hand position;

b) providing a specific number (e.g., one, two, three, four, five or more, but with two being used in the non-limiting example) two random physical playing cards to a dealer hand position, and providing two random physical playing cards to the player hand position (e.g., one, two, three, four, five or more, but with two being used in the non-limiting example), wherein if only one dealer random physical playing card is initially provided face-up, exactly three random physical playing cards are used in determining outcomes in the physical playing card wagering event, and if both dealer hand random physical playing cards are dealt face-up, then four random physical playing cards provided are used in determining outcomes in the playing card wagering event;

c) determining the spread between the two random physical playing cards in a hand on which the side bet wager has been placed;

d) determining whether the side bet has been lost because of a spread of zero between the two random physical playing cards in the hand on which the side bet wager has been placed;

e) upon determining that there is a spread in excess of zero between the two random physical playing cards in the hand on which the side bet wager has been placed, the player position hand and uses a third playing card which appears in a position selected from the group consisting of a dealer position card, a player position third playing card, a community card, and a randomly displayed image of a card to determine if the third card lies within the spread in excess of zero to resolve the side bet;

f) determining if the third playing card is within or not within the spread; and g) resolving the side bet wager against a paytable which identifies odds dependent on the spread determined in e) based upon the determination whether the third playing card is within or not within the spread;

wherein at least a portion of the side bet wager, but less than all of the side bet wager is contributed to a progressive jackpot, the amount of which is stored, incremented and decremented in a processor, decrementing being based in-part upon resolution of the side bet for outcomes where percentages of a total in the progressive jackpot are awarded for defined random event outcomes when the third playing card is within the spread, and the processor sends a signal to a display screen available for view at the player position indicating status of the jackpot amount.

The method may require the display of exactly and only three random physical playing cards to determine an outcome in the progressive jackpot side bet and the method is performed on the gaming table and the side bet wager is provided through an electronic wagering input device at the player position on the gaming table to the processor, and the input device communicates location of a player position at which a side bet wager has been placed and an amount of the side bet wager to the processor. The processor preferably transfers a portion of at least 10% and less than 60% of the side bet wager into a progressive jackpot account monitored by the processor and the processor causes a display to visually indicate an available balance in the progressive jackpot. The method may provide a highest payout from the progressive jackpot within comprises the third physical random playing card being a suited rank card within a spread created by two of the same suited playing cards that provide a spread of one at the position at which a side bet wager has been placed and an amount of the side bet wager to a processor and the card-receiving position for each of the random physical playing cards is lit by lights at the card-receiving positions by random selection by the random number generator communicated to the processor. The method may also provide a highest and proportional amount of the progressive jackpot with any preselected specific suit and rank cards (e.g., 1, 2, 3, 4, 5, or 6 cards) without any ordering, if they are provided and then randomly lit to provide the defined combination of numbers of cards, ranks, suits and/or lighted cards according to a paytable. For example, the probability of the random lighting may be 1:50, so that the random lighting on four card positions, without reference to suit and rank of playing cards, would provide a frequency of the 100% winning outcome at 1:6,250,000, which would roughly provide an average jackpot size (including for example, 5%, 10% and 20% withdrawals from intermediate 1-lit card, 2-lit cards, and 3-lit cards) of about 2 million wagering units. This would also provide intermediate payouts of 50, 2500, and 125,000 units. If the maximum payout were for three of four card positions (e.g., baccarat) being lit, without reference to the playing cards, with a 20% house advantage, the payouts would likely be about 15-25 for a single light, 500-1,200 for two lights, and 10,000 to 50,000 for three lights.

In a three-card initial display wagering event (e.g., the two player cards and the dealer up-card), a lights only event might have a light frequency of 1-10 to 1 to 200 for each position. This would enable maximum payouts at a frequency of about 1:8,000,000 for the 1:200 predetermined light frequency. The average payout for intermediate lights only hits, with no particular rank or suit required could be 20-50:1 for one light, 200-1000:1 for two lights and 500,000 to 2 million (or higher) for three lights at this 1:200 frequency. These parameters are completely in control of the designer using the enabling unique gaming system iof the present technology. Rather than specific suits and ranks, general ranks may be used (e.g., any J-Q-K) along with the lighting factor or just specific suits (three spades for 100% jackpot with three lights, three hearts for 50% jackpot with three lights, three diamonds for 25% of the jackpot with three lights, and 10% for three clubs with three lights). The lighting offers a level, parameter, dimension of control over the odds, frequencies and psyout amounts and rates not heretofore seen in the industry, without requiring the use of specifically marked playing cards.

The highest payout from the progressive jackpot may include the third random physical playing card being a suited rank card within a spread created by two of the same suited playing cards that provide a spread of one at the position at which a side bet wager has been placed and an amount of the side bet wager to a processor and at least one of the three cards has a bonus indicator provided by the light at the card-receiving position for at least the suited ranked physical playing card for the side bet to win 100% of the jackpot. Any other card combination may be used. Three card poker ranks, for example may be used in combination with a requirement of 1, 2 or 3 lights being randomly provided for those three playing cards. The method may require that the two cards defining a spread in the side bet are placed at a location adjacent the position at which a side bet wager has been placed, and the third card is placed between and/or at the bottom of the two random cards at the position at which a side bet wager has been placed.

The method may require the use of playing cards as physical playing cards provided from an electromechanical device providing one or more random physical playing cards for manual delivery to a distinct player hand physical position on a gaming table and a distinct dealer hand position on the gaming table. The various lighting parameters discussed above may be used with these playing cards. It is preferred that the two random physical playing cards define a spread in the side bet are placed at a location adjacent the position at which a side bet wager has been placed, and the third random physical playing card is placed at a distinct location that is different from the position at which a side bet wager has been placed.

Reference to the Figures may provide additional understanding of the present technology.

FIG. 1 shows a gaming table system 400 with a game play surface 402. A set of electronic components of processor 406, random number generator 404 and progressive jackpot display 408 are shown in one-way or two-way communication with the game play surface 402. On the game play surface 402 are shown two dealer card-receiving positions 410*a* 410*b*, and five (5) sets of two-card player card-receiving positions 412*a*-412*b*, 414*a*-414*b*, 416*a*-416*b*, 418*a*-418*b* and 420*a*-420*b*> There are rows of lights or pixels (e.g., lights provided by bulbs, semiconductors, liquid crystals, LEDs or any other light emitting structure) 426 on the game play surface 402. The individual light emitters may be analog or digital and may be evenly distributed across the game play surface 402 or located (only or in part) immediately about the card-receiving locations (e.g., all of 410*a*-420*b*, inclusive). The processor, executing the function or receiving information from the random number generator (RNG) 404 causes random sets of the lights about the various card-receiving positions (both player and dealer/banker or only player or only dealer) to randomly be lit at the frequency determined by the RNG 404. A shuffler providing the random physical playing cards is shown as 422. Special wagering positions, credit acceptors, side bet entry and/or verification of the presence of the side bet for each player position may be shown by elements 424 which may, for example, be a D.E.Q. (e.g., G3 Platinum™ system) progressive wager input control. Upon the processor indicating to the game play surface that lighting is to be provided at a card-receiving position, lights or pixels in the rows (e.g., 426) adjacent and surrounding (e.g., combinations of ones to the left, right, above and/or below) the card-receiving position are lit to a degree to clearly indicate to an observer (dealer, player and/or by-stander) that a potential jackpot event is in play or any bonus event provided by the side bet wagering event.

The display of the lit areas, must of course be locked in to individual positions after the side bet has been received and further wagers on the side bet have been locked out. The processor will refuse to recognize any further side bet wagers through any component, such as 424 once this lock-out is in place.

A preferred method and apparatus for hosting a modified game of blackjack or baccarat with a player position in competition with a dealer position. The modification includes a side bet as defined herein. The player position and the banker position receiving playing cards from one or more decks of 52 playing cards, as a standard first step in the play of blackjack or baccarat. The dealer may still have one card face-down when first delivered in blackjack. The players' cards are placed face up, and it is desirable if the cards are physically placed on the table with a space between them. The order and position of placement in two spots is not material, but for reasons provided herein, some separation or placement of the player position cards adjacent to each other is desirable.

After the cards are dealt in the blackjack or baccarat event, the cards are viewed and the "spread" determined. The term spread as defined as the space or number of spaces between the two cards on which the wager is placed. For example, the following cards exemplify a spread produced by those cards:

| Cards | Spread | Cards | Spread |
|---|---|---|---|
| Ace and 2 | 0 or 12 | Pairs or 10-value cards | 0 |
| Ace and 3 | 1 or 11 | Ace and 10-value card | 0 |
| Ace and 4 | 2 or 10 | 2 and 10-value card | 7 |
| Ace and 5 | 3 or 9 | 3 and 10-value card | 6 |
| Ace and 6 | 4 or 8 | 4 and 10-value card | 5 |
| Ace and 7 | 5 or 7 | 5 and 10-value card | 4 |
| Ace and 8 | 6 | 6 and 10-value card | 3 |
| Ace and 9 | 7 or 5 | 7 and 10-value card | 2 |
| Ace and 10-value card | 8 or 0 (3, 2 or 1) | 8 and 10-value card | 1 |

As can be seen, the spread relates to the number of card ranks that are available between the two cards on which the side bet wager has been placed. The Aces and 10-value cards may be used in various formats adjusting payout odds in the practice of the wagering event of the present technology. The variations may be used to adjust the house advantage, game volatility and the odds in the paytable. For example, the house advantage may be increased and other payout odds increased and the game simplified by all 10-value cards being considered as a single rank, as opposed to an ascending order of 10, Jack, Queen and King. In the baccarat variation, the 10, Jack, Queen and King may maintain a zero value and be at the bottom of the count ladder, so that there is no spread between the ten-value (zero value in baccarat) cards and aces, and a spread of 1 between the zero value cards and a 2. Also, for purposes of the side bet, the Ace may be considered only a 1-value in baccarat, or only an 11-value in blackjack (except for the jackpot event as described herein), or the value (solely for the purposes of the side bet) be the value that creates the smallest spread with the other card.

It is possible to allow a winning outcome (as described in Published US Patent Application Document No. 20140309017 (LaDuca)) where the wedge card equals one of the two cards defining the spread, but this would not be advantageous to the play of the side bet, cause further confusion among hands with 10-value cards, reduce the house advantage, and as shown by DaLuca, tend to eliminate game event activity for spread defining cards with more than a spread of three cards. This reduces event frequency and volatility benefits. It may be possible to allow such "end-point" ties for only certain spreads, such as only for spreads of 1, 2, 3 and/or 4, but all that this does is effectively change spreads from 1 to 3, 2 to 4, etc.

If there is a progressive component in the side bet, a paytable may be structured as follows, with the unique events described in further detail later on:

A unique event pays 100% of the progressive jackpot. Lesser events may have payouts of from 5%-25 of the jackpot. Other event outcomes may have specific odds as already indicated in the table above, or even lower or higher odds to accommodate the amount contributed to the jackpot. One unique aspect of the content of the game is the identification of a specific three-card combination as the "unique event." Any specific three-card combination may be selected, but for convenience the construction of same-suited Ace-2-3 will be considered. For example, the unique three-card combination that wins 100% of the progressive jackpot may be only the A-2-3 of a specific suit, such as spades. The jackpot may be further qualified in the winning event only when the Ace spades and 3 of spades are the first two cards and the 2 of spades is the third card. As multiple decks of playing cards are used, the probability of the maximum unique event may be further limited by designating only a limited number of the Aces of spades, 2 of spades and 3 of spades may be specially marked (e.g., the casino name) and the 100% jackpot may be paid only when at least one of the three cards in the unique event must be present for the 100% jackpot to be awarded. For example, in an 8-deck blackjack shoe, fewer than all of at least the Aces of spades (or alternatively the 2's of spades and/or 3's of spades) may be marked with the special bonus symbol. For example, in the 8-deck shoe, where there are eight Aces of spaces, only 7, only 6, only, 5, only 4, only 3, only 2 or only 1 may have the special jackpot or bonus marking. The marking may be performed on only one, only two or all three of the unique event cards may be marked, and less than all of one, two or three of cards may be used. The use of multiple ones of the marked cards and less than all of the marked card (or cards) offers the advantage of not dissuading players to avoid the side bet because an only necessary card has already been played, eliminating the possibility of any player obtaining the 100% payout on the jackpot. The use of a continuous shuffler (where all cards are returned to the shuffler after each round of play, and the returned cards are randomly inserted into the residual set of playing cards in the shuffler) partially eliminates that issue from the players. These alternatives provide significant control over the events in the jackpot events of the jackpot wagering. For example, if all three specially marked cards in the sequence are needed for 100% jackpot, the difference in probability going from 8 of each card (Ace of spades, etc.) being functional in the 100% jackpot down to only one of each of the cards in the unique event being marked can change the probability of that event occurring by more than 100-fold. The use of non-marked equivalent cards in the unique event (e.g., Aces of spades without the special mark) also adds to the availability of smaller, but significant jackpot payments. For example, if the specially marked A-2-3 of spades (or any other suit) is needed for the 100% jackpot payout, combinations (of A-2-3 of spades) for example with only one of the specialty cards (e.g., a specific one card or any card) may pay 5-10% of the jackpot and combinations (A-2-3 of spades) with two marked cards may pay 10-25% of the jackpot. This shows the flexibility of the wagering event.

Certain jurisdictions may have regulations that require that the largest available jackpot winning outcome must be available for that wager to be allowed. For example, in the event that a uniquely marked Ace, uniquely marked 2 and uniquely marked 3 are required for the final 100% jackpot winning event, in theory, once all of the specially marked cards of a single value are exhausted from tan original set (shoe) of playing cards, the side bet wager might no longer meet regulations. This can be addressed in numerous manners. As noted elsewhere, a continuous shuffler may be used so that all recently used cards are immediately returned to the set of playing cards. Alternatively, with card reading delivery shoes and card-reading shufflers, the processor can be configured to determine when all of at least one essential specially marked card (from the set of three or set of at least two specific cards) has been exhausted from the set of available random playing cards. For example, if a specially marked Ace of spades is needed for the 100% jackpot, and there were four marked Aces of spades out of a six-deck show, once all four of the marked Aces of spades have been used, the shoe/shuffler is shut down and a new set of playing cards provided. An alert notice can be provided by an alphanumeric display on the delivery shoe or shuffler, or a special alert bulb or alarm can be provided. The card set would be replaced immediately after the last available necessary specialty card was provided. Where at least two cards with jackpot specialty marks are needed for the Jackpot (e.g., at least two of the Ace-2-3 same suited cards must have the specialty marks), all three cards may be tacked by the card-reading shoe or shuffler, and when two of the three ranks of cards have been exhausted, then the notice, alert or alarm would be provided.

FIG. 2 shows a panel 250 with three distinct columns 252*a*, 252*b* and 252*c* indicating, respectively, remaining numbers of specially marked Aces of Spades, 2 of Spades and 3 of Spades. The panel may also be provided as a marked area controlled by a live dealer, who moves a marker or lamer from positions within the panel 250 to indicate exhaustion of critical cards. As shown in FIG. 2, there are spaces in the panel 250 indicating availability of four (4) of each of the specially marked cards critical to winning outcomes that award percentages (e.g., 5%, 10%, 15%, 20%, 25% or 100%) of the total jackpot accumulated. As shown in the FIG. 2, spaces have markers that indicate remaining numbers of critical cards of specific rank by a symbol e.g., Φ 254*a* indicating there are three of four original specially marked Aces of Spades cards. The panel may have only indications of three critical cards and marked appropriately. In the panels, the O's are neutral marks or spaces where lammers or markers may be placed. In FIG. 2, the position of the markers Φ 254*b* indicates four available 2 of Spades and Φ 254*c* indicates two available 3 of Spades. In this way, legal compliance may be observed and information provided to players. It is not necessary to make such indications on electronic gaming machines where new sets of playing cards (e.g., in increasing order of preference, a single deck, two decks, four decks, sic decks, eight decks, etc.) are provided at the beginning of each round of play. Numbers of each of the specialty cards may be varied to further control the odds in the electronic systems. Numbers of specially marked cards may even be varied according to the time of day to weight probability of a win so that larger numbers of people may be available to observe a major win. For example, the normal level of three or four specially marked cards of each critical card (generally exemplified as the Ace of Spades, 2 of Spades and 3 of Spades, although other combinations may be used, especially where the dealer position up card is used as the random third card) may be four cards in eight decks, and the reduced (but still legally allowable) frequency at different times of play may be three of each (or fewer than all, such as only 2's of Spades) specially marked card or even two of each (or less than all, such as only Aces of Spades and 3 of Spades) to reduce the probability of each major percentage win from the progressive jackpot.

As has and will be particularly indicated, many variations within the disclosure of this technology are available. For purposes of examples, A-2-3 or A-K-Q of same suited and specially marked cards have been particularly indicated. These are exemplary but arbitrary specific ranks as the use of spades and hearts in the discussion are arbitrary suits for the unique percentage jackpot awards. As within different cultures, different numbers can have different connotations, such as 4 and 8 in certain Pacific Rim cultures, the unique card combinations and outcomes may include these emotive cards in the jackpot events. For example, the spread may be determined by ranks of 3 and 5 (so that the 4-value card is the wedge card), 7 and 9 rank cards (so that the 8-value card is the wedge card) or 6 and 8 rank cards so that a 7-rank card is the wedge card. Any designated card, even cards without a single spread range may be used. For example, if the jackpot winning event is arbitrarily selected as 2-4-6, or Ace-3-5, or 2-4-8, or 4-8-King, those cards may be specially marked in a selected suit or even combination of suits, and the appearance of the outermost spread defining cards, 2-6, Ace-5, 2-8 and 4-King, respectively, makes the jackpot percentage award available. The only drawback with some of these variations is potential confusion if a filling card other than the bonus card is provided, or if different suits are used in the percentage jackpot awards, the determination of the final outcome is more confusing and time consuming. The use of a single suited event and a spread of any combination of cards with a single rank between them is the simplest and least confusing event.

In baccarat side bet events, similar considerations may be used. In a two-card spread baccarat game, for example, the spread hand (in either the player hand position or the banker hand position, by design or by allowance of either position with the side bet) may be the Ace and 4-rank of the same identified suit, and the winning wedge hand will be both the 2-rank and 3-rank cards of the same suit and preferably also the special markings on at least one, two, three or four of those cards. The order of the rankings and distribution of the rankings should be maintained as a split event to keep the feel of the Acey-Deucy type game and for ease of resolution and control of the probabilities. For example, the presence of A-4 in one hand and 2-3 in the other hand is much less likely than the appearance of all four of A-2-3-4 in both hands without consideration of distribution. That format could be used, but that would cause the jackpot event to have lower totals because of more rapid payouts. The payouts could also be made more frequent or otherwise adjusted by having a 5% payout for one specially marked card, 10% for two specially marked cards, 20% for three specially marked cards and 100% for four specially marked critical cards. To control the frequency of payouts and jackpot rate of growth in baccarat, a higher frequency of specially marked cards may be needed for 100% jackpots to be paid out. For example, in the blackjack variant of the side bet wedge event, it is believed that three or four specially marked cards provides a desired balance between frequency of payouts of percentages of the jackpot and rate of growth and size of the jackpot. In the baccarat variant, because two filling same-suited, specially marked cards must form the wedge event (as opposed to one filling card) the frequency of the event is reduced. It is therefore felt that four, five or even six specially marked ones of the same-suited critical cards is more desirable. This will increase the frequency of the smaller jackpot payouts, and their size may be accordingly lowered to keep the rate of growth of the 100% jackpot amount higher. For example, the one specially marked card successful wedge event may pay 2-4%, the two specially marked card successful event may pay 3-7%, the three specially marked card successful wedge event may pay from 7-15% and the four specially marked card successful wedge event (e.g., 1-4 in one hand and 2-3 in the other hand) would pay 100%. Again, the selection of rank and suite can be varied. The winning combinations can be hand distributions of 2-5 and 3-4, 3-6 and 4-5, 10-K and J-Q, J-Ace and K-Q and the like. Again, it is simplest if the spread is kept at two ranks and the edge must fill exactly the two same-suited cards within those rankings, with at least one specially marked card present.

The paytable for the four-card baccarat wedge event must be significantly different from the blackjack paytable. Spreads of one may also be "dead hands" in the baccarat game as only a specific rank pair can be between both cards. This could also be a high payout award. For example, where the spread hand is 3-5, the wedge hand of 4-4 might pay 25:1. It is desirable to require that both wedge hand cards fall within the split for simplicity, although there might be small award odds for single cards. Requiring both wedge hand cards to fill the spread will create much higher volatility, with much higher odds available. It is also likely that each of 10, Jack, Queen and King will be) value cards and of equal rank in play, as this comports with play in baccarat. An exemplary range of payouts for the wedge side bet be:

| Spread | Two Card Wedge Fill |
|---|---|
| 1 | 10:1 to 50:1 |
| 2 | 8:1 to 25:1 |
| 3 | 4:1 to 20:1 |
| 4 | 3:1 to 12:1; or 0:1, 1:1 or 2:1 |
| 5 | 3:1 to 5:1; 1:1, 2:1 or 0:1 loss |
| 6 | 2:1 to 4:1 or 0:1 loss to 1:1 |
| 7-8 | 1:1 or 0;1 loss |

The odds may be varied outside these ranges. Joker(s) cards may also be used as null special cards with different payouts or payout multipliers. Payouts in excess of 10:1, 15:1 or 20:1 may or may not be decremented from the jackpot.

In electronic gaming, video gaming, on-line gaming and the like, many of the above problems associated with depletion of critical specially marked cards become trivial. Multiple decks may be used with a single specialty marked card for one, two or three of the unique event cards, and new virtual sets of cards may be provided at the beginning of each round of play.

The method generally may have steps of: performing a side bet event during a blackjack or baccarat wagering event according to the present technology (the side bet amount may be any minimum amount, such as $1.00 or may be in amounts up to the table minimum or maximum), and the steps includes:

a) a player position providing a side bet wager to be determined by playing cards provided to the dealer hand (banker hand position in baccarat) position and/or the player hand position; (the wager may be placed on the player hand, a dealer hand or even a dummy hand as later described. As explained, there are advantages to each option.) The dealer position up-card may be best used as the card indicating whether the spread in the player hand is filled. That is because the play of the underlying game is not affected, and the side bet game is immediately resolved. Tension is still provided by waiting to see the dealer up card. The use of the player hand in the side bet wager assures the likelihood of only a single winner. The use of the dealer hand in the side bet wager would assure that all players entering the jackpot event at a single table would share the jackpot if won. If a dummy hand is used at the end of game play (receiving a required third card for the split or fill wager side bet event), two cards are dealt to the dummy position and a third card dealt to determine the event outcome, players will not feel that any actions done by intermediate players are affecting their own chances of game events. This method would also assure that all players entering the jackpot event at a single table would share the jackpot if won.

b) providing two random playing cards to a dealer hand position, and providing two random playing cards to a player hand position face up; (Placement of the cards can have significance for security issues, so that a third card is not intentionally or accidentally confused with one of the original cards dealt to the position on which the side bet wager has been placed. The cards may be placed adjacent each other (with no space between them, and the third card placed overlapping a lower portion of both playing cards. The cards may also be placed on two spaces specifically marked or generally positioned for receiving the first two cards, with the space between them marked or sufficiently wide that placement of the third card should be clearly distinguished from the other cards. The dealer position may also have the first two cards (even with one face-down) similarly positioned when the third card (if any) is delivered to the dealer position.

c) providing a third random card to the hand(s) on which the side bet wager has been placed; and d) resolving the side bet wager against a paytable on a basis of whether the third random card has a rank within the spread and size of the original spread.

A non-limiting example of a paytable for the side bet wager (without a progressive event) may be as follows:

| SPREAD | PAYOUT ODDS |
|---|---|
| 1 | 8:1 to 12:1 or 10:1 to 15:1 |
| 2 | 5:1 to 6:1 6:1 to 8:1 |
| 3 | 3:1 to 4:1 4:1-6:1 |
| 4 | 1:1 to 2:1 2:1 to 4:1 |
| 5 | 1:1 to 2:1 2:1 to 3:1 |
| 6 | 1:1 to 2:1 2:1 |
| 7 or more | 1:1 1:1 |

The exact math and an alternative paytable for the progressive jackpot side bet events (without including jackpot payouts) may be:

| Event | #(Event) | P (Event) | Odds (1-in) | Payout (n FOR 1) | Value |
|---|---|---|---|---|---|
| Pair, no spread | 10,426,176 | 0.14587581 | 6.86 | 0 | 0.00000000 |
| Ace + ten value, no spread | 3,391,488 | 0.04745134 | 21.07 | 0 | 0.00000000 |
| One gap, no spread | 10,174,464 | 0.14235403 | 7.02 | 0 | 0.00000000 |
| Loss | 34,635,776 | 0.48459971 | 2.06 | 0 | 0.00000000 |
| Win, spread 1 | 720,896 | 0.01008628 | 99.14 | 10 | 0.10086280 |
| Win, spread 2 | 1,310,720 | 0.01833868 | 54.53 | 5 | 0.09169340 |
| Win, spread 3 | 1,769,472 | 0.02475722 | 40.39 | 4 | 0.09902888 |
| Win, spread 4 | 2,097,152 | 0.02934189 | 34.08 | 2 | 0.05868378 |
| Win, spread 5 | 2,293,760 | 0.03209270 | 31.16 | 1 | 0.03209270 |
| Win, spread 6 | 2,359,296 | 0.03300963 | 30.29 | 1 | 0.03300963 |
| Win, spread 7 | 2,293,760 | 0.03209270 | 31.16 | 1 | 0.03209270 |
| Win, spread 8 | 0 | 0.00000000 | 0 | 0 | 0.00000000 |

These numbers were derived from computer-generated outputs simulating 71,472,960 rounds of dealing and provided a player return of 44.75% and a house advantage (on the underlying play, which does not include the jackpot) of 55.25%. By contributing, for example, 35% of all side bet wagers to the jackpot, there would be a residual house advantage of 20.25%. There may also be a side bet progressive component, with a portion of the side bet wager being automatically contributed to a progressive jackpot. Anywhere from 10% to 90% of all side bet wagers may be used to contribute the jackpot, with underlying odds on the WEDGE event payouts adjusted.

Greater or lesser volatility and house advantage can be easily provided

General Considerations for Side Bet for Blackjack with Progressive Component

Side Bet must be made before cards are dealt in normal blackjack fashion.

Side Bet may be in any amount up to Ante or maximum values.

Side bet is on an Acey-Deucey type event against a paytable.

If any player's third card is a value between the values of the first two cards, it is a winning outcome. The paytable may be based on size of range between first two cards without busting. (Depending on math, a bust of 22 may be allowed for the side bet if the player must take a third card in a circumstance where a hit would ordinarily not be taken.)

The preferred method of play, however, is using the dealer up-card as the third random card indicating whether or not the spread in the player hand is filled and the side bet won, at odds or percentages of the jackpot.

With a 2 and 9 or ten value card as first two cards (a six or seven point spread), any value between 3 and 9 pays 1:1.

With any four or five point spread, side bet pays at least 2:1.

With any three point spread, side bet pays at least 4:1.

With any two point spread, side bet pays at least 6:1.

With a one point spread (e.g., 6 and 8), the side bet pays at least 10:1.

Jackpots may be paid when first two cards are any two same-suited, 2 or 3. That will pay 10% of the progressive jackpot, unless the first two cards are the Ace and Three of Spades and the third card is the 2 of Spades, especially with one, two or three of the Ace, 2 and 3 having special markings thereon. (Described in greater detail above)

There are other controls over game play that can impact the house advantage and play. For example, the player may lose the side bet with a natural hard 17 (as no card can be between the 10-value card and the 7 without busting) and pushes or loses with a natural 18, 19 or 20 and loses, pushes or wins 1:1 with a blackjack.

It is to be noted that the odds for the various spreads are merely exemplary. In fact, odds at variance with apparent normal odds may be used. For example, the 10:1 odds appear to be typical odds for an event with a 1/13 probability. However, as the condition for the wager may not occur (the initial hand may be "dead" by being a pair, consecutive cards, face cards, etc. so the split side bet event may not occur), so that actual offered odds may be higher than even the statistical probabilities. For example, for a spread of one, odds of 13:1, 14:1; 15:1 or even higher may be offered. For a spread of two (with statistical odds of 1/6.5), odds of 6:1, 7:1 or even 8:1 or higher may be offered. In this manner, the casino may offer payout odds that are statistically higher than the probability of the spread being filled by a third card.

As can be seen, the player always also loses the underlying wager in blackjack when the player MUST take a hit to provide the third random card, with a natural 16 on the first two cards, as no card can be between 6 and 10 without busting. A same value card as either of the original cards is a loss. It is also possible to allow players to take a hit "off the books" for the blackjack event or baccarat event, such that the player may exercise a step in the side bet, without altering normal play in the blackjack game. This is the advantage of using electronic gaming or the dealer up card as the third playing card. It would also be desirable on electronic systems, or electronic gaming tables or electronic gaming machines (especially where there are multiple players) to have the spread identified, before, during or after provision of the wedge card, as this would be informative to the player(s).

A method of performing a side bet wagering event during a playing card wagering event on the gaming system described herein can be performed in which playing cards are exposed after being provided during play of the playing card wagering event including:

a) the player position providing a side bet wager against a paytable and a jackpot to be determined by playing cards provided to a card-receiving position at least one of a dealer hand position and the player hand position;

b) providing random physical playing cards to at least the dealer hand position and/or to the player hand position; and c) the processor making a random determination as to whether lights at the card-receiving position are to be lit or not lit.

The multiple random physical playing cards may be dealt to multiple card-receiving positions on the game play surface of the gaming system, and the processor makes a random determination as to whether lights at each of the multiple the card-receiving positions are to be lit or not lit; and causing lights to be lit or unlit at at each of the multiple the card-receiving positions according to the random determination. The method may also resolve the side bet wager against the paytable or jackpot (including a progressive jackpot based at least in part upon how many lights at the multiple card-receiving position are lit or not lit. At least two or at least three random physical playing cards are dealt to at least two or at least three card-receiving positions and the random number generator communicates random number selections to the processor, the random number selections being individually indicative of whether or not lights at each of the multiple card-receiving positions; and lights being lit or being unlit depending upon communication from the processor to individual light controls for lights at each of the multiple card-receiving positions. Alternatively, the random number generator communicates a single random number selection to the processor, the single random number selection being indicative of a single template indicating whether or not lights at each of the multiple card-receiving positions are to be lit or not lit; and lights being lit or being unlit depending upon communication from the processor to individual light controls for lights at each of the multiple card-receiving positions based upon the single template. The method may be practiced wherein exactly four random physical playing cards are dealt (e.g., in baccarat) to exactly four card-receiving positions and the random number generator communicates a single random number selection to the processor, the single random number selection being indicative of a single template indicating whether or not lights at each of the exactly four multiple card-receiving positions are to be lit or not lit; and lights being lit or being unlit depending upon communication from the processor to individual light controls for lights at each of the exactly four multiple card-receiving positions based upon the single template. The templates would cover all ranges of events in individual or collective lighting of card-receiving positions, from zero positions lit to all positions (22-24 positions with seven players, one dealer and three initial player position cards and three initial dealer playing cards, with 1 or 3 cards exposed for the dealer/banker; or only 4-6 cards in baccarat, with two initial cards and a maximum of one additional hit card position). The available templates must therefore include (weighted or unweighted) a large number of possibilities, with every variation of lighting of individual card-receiving locations, which is approximately 24! (twenty-four factorial) individual events (approximately more than 100 billion probabilities, and this without weighting of individual events (e.g., weighting provides a larger number of outcomes that may be randomly selected than is physically or numerically possible, such as in choosing between 1 and 10, then gives dispropostionate numbers of chances to each selection, such as providing 100 selectable outcomes for ten events, with 20 selectable events for 1, 15 selectable events for 2, and as few as one selectable event for 10, thus probability weighting each outcome). The system may be used for any dealing event, with any number of playing cards, but one preferred modality is when exactly and only three random physical playing cards (e.g., the three up cards in blackjack, three card poker, the three communal cards first dealt in Texas Hold'Em) to determine an outcome in the progressive jackpot side bet and the method is performed on the gaming table and the side bet wager is provided through an electronic wagering input device at the player position on the gaming table to the processor, and the input device communicates location of a player position at which a side bet wager has been placed and an amount of the side bet wager to the processor. The processor may transfer a portion of at least 10% and less than 60% of the side bet wager into a progressive jackpot account monitored by the processor and the processor causes a display to visually indicate an available balance in the progressive jackpot. The jackpot My be a progressive jackpot and a highest payout from the progressive jackpot comprises a third physical random playing card being a suited rank card within a spread created by two of the same-suited playing cards that provide a spread of one at a hand position at which a side bet wager has been placed and the card-receiving position for each of the multiple random physical playing cards is lit by lights at the card-receiving positions.

A new gaming technology, referred to a Mix and Match gaming events in poker, blackjack and baccarat. These gaming events are in part disclosed in U.S. patent application Ser. Nos. 14/620,158 and 14/677,974 filed 3 Apr. 2015, both of these references being incorporated by reference in their entirety to described the underlying wagering Mix and Match wagering event.

The blackjack variant may be generally described as a method for conducting a blackjack card game using:

a) accepting an ante wager on a round of blackjack at a player position;

b) providing three random playing cards to a display system at a player position and three random playing cards to a dealer position, c) the blackjack card game being played between the dealer position and the player position according to the predetermined rules of blackjack card games utilizing playing cards where all face cards count ten, aces count one or eleven, and all other cards count their face value, in which each player position makes the ante wager; d) the player position discards one card to form an initial player position two-card blackjack hand;

e) the dealer position discards one card to form an initial dealer position two-card blackjack hand;

f) the player position receives random cards to complete a blackjack hand at the player position according to player position direction to stand or hit;

g) the dealer position receiving random cards to complete a blackjack hand at the dealer position after f) is completed according to dealer position direction to stand or hit; and h) the dealer resolving all wagers at the player position hand by standard blackjack rules of resolution.

A method completes a wagering event using playing card symbols to determine a random event outcome. The symbols may be provided by physical playing cards or by virtual playing cards provided by a processor. The process proceeds by:

a) recognizing a wager (either a physical wager with a chip, token or currency, or an electronic wager as from a player input terminal received by a processor) from a player position on a player hand win, a banker hand win or a player hand-banker hand tie event according to final digit point count in the player hand and the banker hand;

b) providing exactly three random standard playing cards face-up to a player position;

c) providing exactly three random standard playing cards face-up to a banker position;

d) discarding exactly one random standard playing cards from each of the banker hand and the player hand to form a two-card baccarat player hand and a two-card banker hand;

e) completing the two-card baccarat player hand and the two-card banker hand according to standard requirements of staying and hitting on point counts in the two-card baccarat player hand and two-card banker hand to form a final player hand and a final banker hand;

f) summing up point count in each of the final player hand and the final banker hand separately, and valuing the player hand and the banker hand according to a last digit only in summed up point count;

g) determining outcomes in a comparison between the player hand and the banker hand as follows:

i) a higher summed up point count in the player hand as compared to the summed up point count in the banker hand is a winning outcome for the player hand;

ii) a higher summed up point count in the banker hand as compared to the summed up point count in the player hand is a winning outcome for the banker hand;

iii) an identical summed up point count in the player hand as compared to the summed up point count in the banker hand is a tie outcome for both the player hand and the banker hand;

resolving wagers in a) according to determined outcomes in i) and ii) and iii) at payout odds against wagers in a) according to outcomes i), ii) or iii) determining the outcome of the wagers.

Player (either with tokens, chips, currency or the like in a table game; or with credit in an electronic gaming machine version) may choose to bet on the Player hand, the Banker hand or a Tie event.

As in traditional Baccarat and mini baccarat, the dealer (or electronic computer acting as a virtual dealer) will deal one hand for the player and one hand for the Banker using the following drawing rules after a starting two-card hand is formed from the original three-cards at each of the player hand position and the banker hand position:

These cards are scored using the traditional Baccarat scoring method, with the numerical value of all cards in a hand summed (with 10, Jack, Queen and King being zero value) and only the last digit (the unitary value digit) being considered.

Ties. If the final Player and Banker point total is equal, a tie wager will pay between 7:1 and 9:1, usually 8-1.

A method of playing a simplified wagering game using playing card symbols to determine a random event outcome may include:

a) recognizing a wager on a player hand win, a banker hand win or a player hand-banker hand tie event according to final digit point count in the player hand and the banker hand;

b) providing exactly three initial random standard playing cards face-up to a player position;

c) providing exactly three initial random standard playing card face-up to a banker position;

d) discarding exactly one standard playing card from each of the three standard playing cards in the banker hand and the dealer hand to form a starting two-card player hand and a starting two-card banker hand;

e) summing up point count in each of the starting player hand and the starting banker hand separately standing or hitting according to standard baccarat rules to form a final player hand and a final banker hand;

f) determining outcomes in a comparison between the player hand and the banker hand as follows:

i) a higher summed up point count in the final player hand as compared to the summed up point count in the final banker hand is a winning outcome for the final player hand;

ii) a higher summed up point count in the final banker hand (whether from a three-card only hand or a two-card hand) as compared to the summed up point count in the final player hand is a winning outcome for the final banker hand;

iii) an identical summed up point count in the final player hand as compared to the summed up point count in the final banker hand is a tie outcome for both the player hand and the banker hand;

g) resolving all wagers with payout odds in a) according to outcomes i), ii) or iii) determining the outcome of the wagers.

The method of resolving each of wagers determined by i) and ii) are resolved with 1:1 odds when the player hand has a higher count than the banker hand, with 1:1 odds when the final banker hand count is higher than the final player hand count (typically with a commission of 5, 10 or 15% taken from the 1:1 payoff on a banker hand winning wager). The wager determined by iii) is resolved with odds of at least 7:1, up to 9:1 and usually at 8:1.

The method is best performed where discards are required so that a highest count of 6, 7, 8 or 9 is formed in the two starting hand cards if possible and a lowest count among 0, 1, 2, 3, 4 and 5 is formed in the two starting hand cards. Variations in the best performance requirements may be that a highest count of 5, 6, 7, 8 or 9 is formed in the two starting hand cards if possible and a lowest count among 0, 1, 2, 3 and 4 is formed in the two starting hand cards.

The method is preferably performed where playing cards are provided by provision of random physical playing cards provided from a randomized source of physical playing cards, and the physical playing cards are placed one-at-a-time from the source of physical playing cards to respective player hand position and banker hand.

The method may be performed on a gaming table and the side bet wager are provided through an electronic wagering input device on the gaming table, and the input device communicates location of a player position at which a side bet wager has been placed and an amount of the side bet wager to a processor. The processor may transfer a portion of the side bet wager into a progressive jackpot account monitored by the processor and the processor causes a display to visually indicate an available balance in the jackpot. The method may designate a highest rank formed with only the four cards from a combination of the two random playing cards in the banker position hand and the two random playing cards in the player position hand is a pair or three-of-a-kind no winning outcome is present on the paytable. The method may be executed wherein when a highest rank formed with only the four cards from a combination of the two random playing cards in the banker position hand and the two random playing cards in the player position hand is a pair or three-of-a-kind no winning outcome is present on the paytable, or when a highest rank formed with only the four cards from a combination of the two random playing cards in the banker position hand and the two random playing cards in the player position hand is a pair or three-of-a-kind no winning outcome is present on the paytable, or when a highest rank formed with only the four cards from a combination of the two random playing cards in the banker position hand and the two random playing cards in the player position hand is a straight, no winning outcome is present on the paytable, or when a highest rank formed with only the four cards from a combination of the two random playing cards in the banker position hand and the two random playing cards in the player position hand is a flush, no winning outcome is present on the paytable. Various low frequency combinations of playing cards may be used as the four-card poker ranks to determine maximum payouts from the progressive jackpot. For example, a maximum payout from the progressive may be selected from the group consisting of four-of-a-kind and a same-suited A-K-Q-J. The method may be formed with other defined hand conditions to increase or reduce the frequency of the ranks that provide the maximum payout from the progressive jackpot. For example, the highest payout rank may be selected from the group consisting of a same-suited four-of-a-kind and a same-suited A-K-Q-J wherein the A-K are in a single one of the player position hand or the banker position hand.

As further described and enabled herein, the method may be performed wherein multiple players have placed side bet wagers against the paytable, at least some of the players being at player positions at a gaming table and at least some of the players being in electronic communication with the gaming table through the processor. A game performance issue occurs with this type of cross-technology and large number of players situations. As all side bet wagers rely on a single set of four cards (the first two banker position cards and the first two player position cards), the jackpot can be divided into so many small parts that the jackpot event becomes less attractive. For example, players would be attracted to a $1.00 side bet with a potential $50,000 or higher payout. However, if there are 100 players making side bets, an equal division of the jackpot would be only $500.00. Knowledgeable players would not be attracted to that side bet event because of the low return as compared to the probability of occurrence. A less desirable format is therefore where upon occurrence of a maximum payout event, the maximum payout is divided among all players having made the side bet. Numerous protocols can be implemented, especially with electronic wagering and a processor in the system. One simple adjustment is to limit the total number of players that can enter the side bet event (for example, in a first-come, first serve mode), or to apportion shares in the maximum payout based on amounts wagered on the side bet event (e.g., a $5.00 wager receiving five times the portion that a $1.00 wager would receive.

There are additional protocols wherein the processor is configured to execute a protocol that divides the maximum payout unequally among all players having made the side bet. The method could be configured such that the processor receives and stores electronic data from electronic wagering input devices comprising at least some data selected from the group consisting of a) length of time a player position has been wagering at the gaming table, b) number of consecutive hands that have been wagered on from a player position, c) average value of wagers made from a player position, d) maximum wager placed from one player position as compared to all player positions making side bet wagers, e) a random selection among players, and f) identified subsets of players based upon betting histories.

In baccarat, versus blackjack, similar procedures may be used. The banker hand or the player hand may be indicated (by wager or fixed rule, preferably as the spread defining hand. The two cards in that spread defining hand are dealt and the first card in the other hand is dealt face-up. The side bet (otherwise identical to the blackjack side bet) can be resolved at that point, before the second other hand card is dealt. An alternative variant, with lower hit frequency but accordingly higher payout odds may be used for baccarat. The two hands are referred to herein as the spread hand (in which the spread is determined) and the wedge hand, in which filling of the spread is determined. Two cards are dealt to each hand, and the split wager is resolved by at least one of the wedge hand cards being within the spread and the other of the cards being within the spread or equaling the rank of the (preferably lower rank) other card. The jackpot bonus may be won by the spread hand being a spread of one and the two spread hand cards being a predefined specific rank and suit combination (e.g., A of hearts and Queen of Hearts again, or A of Diamonds and 3 of Diamonds, again with a distribution/control of numbers of these cards that are specially marked. Special marking may be eliminated by requiring that both of the wedge hand cards fill the single rank spread with both wedge hand cards being the suited cards. For example, if the jackpot combination is A-K-Q of Hearts, the spread hand must have the A-Q of hearts, and both cards in the wedge hand must be the King of Hearts. A null card of a joker may also be present so that for the 100% jackpot to be won, the exact wedge card and the joker may be present. Smaller percentages can be won by the wedge hand having the exact filling rank and suit, and the other card being the same rank and the same color, but different suit, or just the same rank. In baccarat, specific order or collective content of specific cards may be used for the jackpot event. For example, the banker or player hand may be required to have the specific suited Ace and 4, the respective player or dealer hand must have the specific suited 2 and 3, and the two hit cards must be compatible with the requirements of the third card rule, the player's third card must be a same suited Ace or 2, and the banker hit must be the same suited 3. This may be done with or without specially marked Aces, 2's and 3's of the desired suit winning the jackpot level of the side bet. A paytable for other events, such as three-card ties, three zero-value cards in both hands, three zero-value same suited cards in individual hands or both hands, etc. These paying events are needed to keep the player engaged in the side bet game.

The wagering event may be practiced with at least one, two, four, six or preferably eight decks as the original set of physical playing cards and two physical playing cards are provided to each of the banker hand position and the player hand position to form a first residual set of physical playing cards having 412 physical playing cards and then any additional physical playing card provided to the player position will be provided from the first residual set of physical playing cards to form a second residual set of physical playing cards having 411 physical playing cards. Any additional physical playing card dealt to the banker position is provided from the second residual set of physical playing cards. As is typical with baccarat and blackjack gaming events, especially high-stake games, the original randomized set of playing cards is not played to exhaustion of the cards where card-counters could identify advantages or disadvantages in events, especially side bet events.

The method may use a set of eight decks of virtual playing cards stored in memory in a processor which is configured to display virtual playing cards on a video display, and two virtual playing cards are provided to each of the banker hand position and the player hand position to form a first residual set of virtual playing cards in the memory having 412 physical playing cards and then any additional virtual playing card provided to the player position will be provided from the first residual set of virtual playing cards to form a second residual set of virtual playing cards having 411 virtual playing cards in memory. Any additional virtual playing card dealt to the banker position is provided from the second residual set of virtual playing cards. Gaming apparatus may comprise a processor, player input controls and a video display, wherein the processor is configured to execute the electronic virtual card method described herein.

Gaming apparatus comprising a gaming table having a randomized physical set of playing cards comprising 312 or 416 playing cards in a dealer shoe with only a back of one card displayed to live players, the gaming table configured to allow play of the physical playing card method described herein. Playing card shufflers or randomizers may be used in accordance with this method as further described herein.

Computer-Based Implementations

Methods of the present invention may be implemented in computer hardware, software, or computer hardware and software. A most common form of computer implementation is a stand-alone, single player electronic gaming machine with electronic player controls and one or more video output screens.

In computer-based embodiments, the gaming device preferably includes at least one processor, such as a microprocessor, a microcontroller-based platform, a suitable integrated circuit or one or more application-specific integrated circuits (ASIC's) or Field Programmable Gated Arrays (FPGA's). The processor is in communication with or operable to access or to exchange signals with at least one data storage or memory device, and/or a player monitor or monitors. In one embodiment, the processor and the memory device reside within the cabinet of a gaming device. Multiple gaming devices are typically connected to a casino information network.

The memory device stores program code and instructions, executable by the processor, to control the gaming device. The memory device also stores other data such as image data, event data, player input data, random or pseudo-random number generators, pay-table data or information, House Ways distributions and applicable game rules that relate to the play of the gaming device. In one embodiment, the memory device includes random access memory (RAM): which can include non-volatile RAM (NVRAM): magnetic RAM (MRAM), ferroelectric RAM (FeRAM), and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical, and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD, or USB memory device.

In other embodiments, part or all of the program code and/or operating data described above can be downloaded to the memory device through a suitable network. In one embodiment, an operator or a player can use such a removable memory device in a desktop computer, a laptop computer, a personal digital assistant (PDA), a portable computing device, or another computerized platform to implement the present disclosure. In one embodiment, the gaming device or gaming machine disclosed herein is operable over a wireless network, for example part of a wireless gaming system. The gaming machine may be a hand-held device, a mobile device, or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "processor" or "computer" or "controller" or "game controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome. It is also possible for templates or weighted templates of sets of tiles or paylines as disclosed in U.S. Pat. Nos. 6,159,096 and 6,117,009 (Yoseloff, which are incorporated by reference in their entirety) which disclose a method of configuring a video output gaming device to randomly generate game outcomes. The method includes the steps of selecting a set of game symbols, assigning a probability of occurrence to each symbol, selecting a plurality of outcome templates, each template comprising X variables, selecting a probability of occurrence for each outcome template, assigning a subset of symbols from the set of game symbols to each template for filling the positions, defining payouts for selected outcomes, and configuring a video output gaming device, which randomly selects a template, randomly selects a symbol for each variable in the template from the subset of game symbols assigned to the selected template, randomly fills at least a portion of the positions in the template and displays the outcome on a video output display. A video output gaming device programmed to randomly select a template, randomly select symbols to define the variables and randomly display the selected symbols is also disclosed.

In one embodiment, described in more detail below as a "chipless gaming platform", the gaming device includes one or more display devices that are mounted into a gaming table surface and are controlled by the processor in addition to or separately from the individual player monitors. The display devices are preferably connected to or mounted into the table structure. This may include a central display device which displays a primary game, dealer images, jackpot information, or information that is not specifically related to the game, such as sports information or winning events at other tables. This display device may also display any suitable secondary game associated with the primary game as well as information relating to the primary or secondary game (e.g., side bets, bonuses, jackpots and the like).

An alternative embodiment may include a central horizontal game display device and a vertically oriented virtual dealer display device as in Shuffle Master, Inc.'s Table Master™ gaming system. The central display device may display the primary game, any suitable secondary game associated or not associated with the primary game and/or information relating to the primary or secondary game. These display devices may also serve as digital glass operable to advertise games or other aspects of the gaming establishment. The gaming device includes a credit display 20 which displays a player's current number of credits, cash, account balance, or the equivalent. In one embodiment, the gaming device includes a bet display displays a player's amount wagered. In one embodiment, as described in more detail below, the gaming device includes a player tracking display which displays information regarding a player's play tracking status.

In yet another embodiment, at least one display device may be a mobile display device, such as a PDA or tablet PC that enables play of at least a portion of the primary or secondary game at a location remote from the gaming device. The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism.

In one embodiment, as described in more detail below, the display device includes a touch-screen with an associated touch-screen controller. The display devices may be of any suitable size and configuration, such as a square, a rectangle or an elongated rectangle. The display devices of the gaming device are configured to display at least one and preferably a plurality of game or other suitable images, symbols and indicia such as any visual representation or exhibition of the movement of objects such as mechanical, virtual, or video reels and wheels, dynamic lighting, video images, images of people, characters, places, things, faces of cards, images of dealers and the like.

Other forms of the invention are in the form of game software that is implemented in a variety of formats, such as internet gaming, PC practice play, hand-held game devices, wireless gaming devices and the like.

Chipless Gaming Table Implementation

One enabling system useful in the practice of the present invention is the use of playing cards with Chinese domino symbols which can be distributed for use with a system marketed under the name i-TABLE™ by Shuffle Master, Inc. of Las Vegas, Nev. That system includes: a) a physical gaming table; b) player monitors at each player position; c) a playing card reading and delivery system (e.g., commercially available shufflers and playing card delivery shoes with reading capability as sold under the Trade names of One2Six™ shuffler, Ace™ shuffler, I-DEAL™ shuffler, I-SHOE™ delivery shoe, etc.); d) a processor receiving information (numbers of cards, rank of cards, suits of cards, etc.) from the card reading and delivery systems; e) communication connectivity (hardwired or wireless) between necessary combinations of the card reading/delivery systems and the processor, the processor and the individual player monitors, and/or the card reading/delivery systems and the video monitors; and f) software in the processor that defines predetermined advantage for distributions of playing cards into multiple hands, game rules, hand history, and the like.

With regard to software f), it is understood in the practice of the present technology that this is not complex software that reads individual player hand cards and determines advantageous card distributions for a first time by extensive calculations. Rather, the entire range of possibilities of hands (e.g., all possible five card sets dealt to players in poker-style games) is known in poker style games.

A preferable card handling device for administering a video reel-type-style game is a hand-forming shuffler with integrated card recognition technology, from which playing cards are supplied, with a least a rank/count (and preferable also suit) of individual packs of cards are known before the cards are removed and delivered to player positions and/or the banker position. The card delivery system 102 is in communication with the controller 128 by wired or wireless communication methods. Communication between the various system components is not limited to electronic or electrical signals, but may include optical signals, audio signals, magnetic transmission or the like.

The shuffling devices work with various physical platforms. The shufflers may create a fully randomized set of cards that are removed one-at-a-time. Other shufflers separate cards into different compartments and then randomly deliver cards from the compartments. Other shufflers order the playing cards in compartments and then randomly select playing cards. Other randomization equipment (which do not actually shuffle cards) takes a set of playing cards are randomly ejects or randomly selects and removes playing cards from a set of playing cards.

The individual player position processors (not shown) are preferable graphics processors and not full content CPUs as a cost saving, space saving, and efficiency benefit. With the reduced capacity in the processor as compared to a CPU, there is actually reduced likelihood of tampering and fraudulent input.

Game history information regarding previous games played such as an amount wagered, the outcome of the game and so forth may also be stored in a non-volatile memory device. The information stored in the non-volatile memory may be detailed enough to reconstruct a portion of the graphical presentation that was previously presented on the gaming machine and the state of the gaming machine (e.g., credits) at the time the game of chance was played. The game history information may be utilized in the event of a dispute. For example, a player may decide that in a previous game of chance that they did not receive credit for an award that they believed they won. The game history information may be used to reconstruct the state of the gaming machine prior, during and/or after the disputed game to demonstrate whether the player was correct or not in their assertion.

Another feature of gaming machines, such as gaming computers, is that they often contain unique interfaces, including serial interfaces, to connect to specific subsystems internal and external to the slot machine. The serial devices may have electrical interface requirements that differ from the "standard" EIA 232 serial interfaces provided by general-purpose computers. These interfaces may include EIA 485, EIA 422, Fiber Optic Serial, optically coupled serial interfaces, current loop style serial interfaces, etc. In addition, to conserve serial interfaces internally in the slot machine, serial devices may be connected in a shared, daisy-chain fashion where multiple peripheral devices are connected to a single serial channel.

The serial interfaces may be used to transmit information using communication protocols that are unique to the gaming industry. For example, the Netplex™ system of IGT is a proprietary communication protocol used for serial communication between gaming devices. As another example, SAS is a communication protocol used to transmit information, such as metering information, from a gaming machine to a remote device. Often SAS is used in conjunction with a player tracking system.

Gaming machines may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this.

Security monitoring circuits detect intrusion into a gaming machine by monitoring security switches attached to access doors in the slot machine cabinet. Preferably, access violations result in suspension of game play and can trigger additional security operations to preserve the current state of game play. These circuits also function when power is off by use of a battery backup. In power-off operation, these circuits continue to monitor the access doors of the slot machine. When power is restored, the gaming machine can determine whether any security violations occurred while power was off, e.g., via software for reading status registers. This can trigger event log entries and further data authentication operations by the slot machine software.

Trusted memory devices are preferably included in a gaming machine computer to ensure the authenticity of the software that may be stored on less secure memory subsystems, such as mass storage devices. Trusted memory devices and controlling circuitry are typically designed to not allow modification of the code and data stored in the memory device while the memory device is installed in the slot machine. The code and data stored in these devices may include authentication algorithms, random number generators, authentication keys, operating system kernels, etc. The purpose of these trusted memory devices is to provide gaming regulatory authorities a root trusted authority within the computing environment of the slot machine that can be tracked and verified as original. This may be accomplished via removal of the trusted memory device from the slot machine computer and verification of the secure memory device contents is a separate third party verification device. Once the trusted memory device is verified as authentic, and based on the approval of the verification algorithms contained in the trusted device, the gaming machine is allowed to verify the authenticity of additional code and data that may be located in the gaming computer assembly, such as code and data stored on hard disk drives. A few details related to trusted memory devices that may be used in the present invention are described in U.S. Pat. No. 6,685,567 titled "Process Verification," which is incorporated herein in its entirety and for all purposes.

Mass storage devices used in a general purpose computer typically allow code and data to be read from and written to the mass storage device. In a gaming machine environment, modification of the gaming code stored on a mass storage device is strictly controlled and would only be allowed under specific maintenance type events with electronic and physical enablers required. Though this level of security could be provided by software, gaming computers that include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present.

During the course of a game, a player may be required to make a number of decisions, which affect the outcome of the game. For example, a player may vary his or her wager on a particular game, select a prize for a particular game selected from a prize server, or make game decisions which affect the outcome of a particular game. The player may make these choices using the player-input switches, the video display screen 34 or using some other device which enables a player to input information into the gaming machine. In some embodiments, the player may be able to access various game services such as concierge services and entertainment content services using the video display screen 34 and one more input devices.

During certain game events, the gaming machine may display visual and auditory effects that can be perceived by the player. These effects add to the excitement of a game, which makes a player more likely to continue playing. Auditory effects include various sounds that are projected by speakers. Visual effects include flashing lights, strobing lights or other patterns displayed from lights on the gaming machine or from lights within the separate mechanical (or electronic) separately, individually wagerable gaming system. After the player has completed a game, the player may receive game tokens from the coin tray or the ticket from a printer, which may be used for further games or to redeem a prize. Further, the player may receive a ticket 20 for food, merchandise, or games from the printer.

A particular gaming entity may desire to provide network gaming services that provide some operational advantage. Thus, dedicated networks may connect gaming machines to host servers that track the performance of gaming machines under the control of the entity, such as for accounting management, electronic fund transfers (EFTs), cashless ticketing, such as EZPay™, marketing management, and data tracking, such as player tracking. Therefore, master gaming controller 1008 may also communicate with an EFT system, EZPay™ system, and player tracking system. The systems of the gaming machine 1002 communicate the data onto the network via a communication board.

A network device that links a gaming establishment with another gaming establishment and/or a central system will sometimes be referred to herein as a "site controller." Here, site controller provides this function for gaming establishment. The site controller is connected to a central system and/or other gaming establishments via one or more networks, which may be public or private networks. Among other things, site controller communicates with game server to obtain game data, such as ball drop data, bingo card data, etc.

In the present illustration, gaming machines and tables may be connected to a dedicated gaming network.

When acting under the control of appropriate software or firmware, in some implementations of the invention a CPU may be responsible for implementing specific functions associated with the functions of a desired network device. According to some embodiments, the CPU accomplishes all these functions under the control of software including an operating system and any appropriate applications software. The CPU may include one or more processors. In an alternative embodiment, processor is specially designed hardware for controlling the operations of any network device. In a specific embodiment, a memory (such as non-volatile RAM and/or ROM and especially a random number generator component or software) also forms part of the CPU. However, there are many different ways in which memory could be coupled to the system. A memory block may be used for a variety of purposes such as, for example, caching and/or storing data, programming instructions, etc.

Regardless of network device's configuration, it may employ one or more memories or memory modules (such as, for example, memory block) configured to store data, program instructions for the general-purpose network operations and/or other information relating to the functionality of the techniques described herein. The program instructions may control the operation of an operating system and/or one or more applications, for example.

Because such information and program instructions may be employed to implement the systems/methods described herein, the present invention relates to machine-readable media that include program instructions, state information, etc. for performing various operations described herein. Examples of machine-readable media include, but are not limited to, magnetic media such as hard disks, floppy disks, and magnetic tape; optical media such as CD-ROM disks; magneto-optical media; and hardware devices that are specially configured to store and perform program instructions, such as read-only memory devices (ROM) and random access memory (RAM). The invention may also be embodied in a carrier wave traveling over an appropriate medium such as airwaves, optical lines, electric lines, etc. Examples of program instructions include both machine code, such as produced by a compiler, and files containing higher-level code that may be executed by the computer using an interpreter.

There are many available variations and standard situations that can be addressed in the execution of the present direct game or side bet event in the present technology. The following discussion will attempt to address those variations, which may be mixed or excluded to implement a side bet wagering event with either blackjack or baccarat.

Aces are generally considered 1-value cards in baccarat. The unique event in baccarat can therefore be either a same-suited Ace-3, or a same-suited Ace-Queen for the 100% payout. Both of those point counts would ordinarily require an additional card, so game play would not be altered in either selection of the unique 100% jackpot event (or 5%, 10%, 20%, 25% etc. jackpot events). Pairs are automatic losses on the side bet for baccarat. In blackjack, players may elect to split pairs, but to engage the side bet event, an additional (preferably equal or less) side bet wager must be placed on a second hand for the second hand to be in play. Otherwise, only the first hand (player's furthest right set of cards).

Ace ranks in blackjack can be more complicated, but can be easily regulated. For example, aces should usually be maintained as an 11-value card for the side bet event. For purposes of the jackpot unique events, however, the rank may be considered as a 1-value card for the Ace-3 combination in first two cards, and may be considered as a 1-value card in combination with a 3 (unsuited), any 4, any 5, (possibly) any 6 (treating the combination as a soft 17), but should be considered an 11-value card with any 7, 8, 9 or 10-value card (not sacrificing a blackjack for the side bet). House procedures may vary this, but the above is recommended.

The occurrence of certain events (with respect to the side bet) has already been addressed, but there are acceptable variations among them. By way of non-limiting examples, so as to minimize a feeling of "unfair" results with the side bet wager, certain natural hands can be specifically addressed. A hard 17 with a 10-value card (as opposed to an 8-9 combination) may be considered a push or a loss. A hard 18 with a 10-value card (as opposed to a 9-9 combination) may be considered a push or a loss. All hard 19's (with a 10-value card) may be considered a loss or a push. All hard 20's (with two 10-value cards) may be considered a loss or a push. All 10-value cards may be considered as a single rank (a rank between 9 and Ace), so that with an initial two cards of 9 and King, the third card of a Jack would not be an intermediate card, nor would a Queen or 10. This may be varied, with the 10 itself being considered as distinct from the Jack, Queen or King in determining intermediate ranks within the spread. All pairs can be considered in the first two cards as losses, unless the player elects to split them and place a second side bet wager for the second hand. If the pairs are aces, however, the side bet is lost as most casino blackjack events allow only a single hit at each hand position when aces are split. This consideration of events complies with standard blackjack practice to minimize alteration of game play.

Players may elect to "convert" an Ace in combination with a ten value card to a 1-value Ace. To do so, the player may be required to double the amount of the side bet, and in that circumstance, it is likely that all 10-value cards would be equal. The "conversion" would also have to be permanent, such that the blackjack is lost. The player may (as with a double down) be allowed only a single hit if this is done, or may be allowed only two hits.

As noted above, event determination with the wedge wager in a side bet for baccarat may be different, even though the generic concepts are similar. A method of performing a side bet wagering event during a baccarat wagering event could include:

a) a player position providing a side bet wager to be determined by playing cards provided to at least one of the banker hand position and the player hand position;
b) providing two random playing cards to a banker hand position, and providing two random playing cards to a player hand position;
c) determining the spread between the two random playing cards in the player position hand or the banker hand position on which the side bet wager has been placed;
d) determining whether the side bet has been lost because of a spread of zero between the two random playing cards in the hand on which the side bet wager has been placed;
e) upon determining that there is a spread in excess of zero between the two random playing cards in the player position hand or banker hand position on which the side bet wager has been placed, both banker position hand playing cards or player hand position playing cards, respectively, are used as a third or fourth random playing card,
f) determining if the third or fourth random playing card is within or not within the spread; and
g) resolving the side bet wager against a paytable which identifies odds at least dependent on the spread determined in e) based upon the determination whether the third or fourth playing card is within or not within the spread;

wherein at least a portion of the side bet wager, but less than all of the side bet wager is contributed to a progressive jackpot, the amount of which is stored, incremented and decremented in a processor, and the processor sends a signal to a display screen available for view at the player position.

Percentages of the progressive jackpot may be restricted to when at least one playing cards determining the spread or in the combination of the third or fourth playing card within the spread has a special jackpot bonus marking on them.

The method may require that the resolution of the side bet as a winning event outcome occurs only when the spread is at least two and both of the third and fourth fill the spread. The different percentages of the jackpot that may be awarded should be restricted to when at least one of the cards determining the spread (of exactly two card ranks) or at least one of the third and fourth cards (exactly filling the two card ranks in the spread) have a jackpot bonus marking on them.

The method may be practiced wherein different percentages of the jackpot are awarded when there are one, two, three or four cards that have a jackpot bonus marking on them. Combinations and variations and adjustments of these event outcome controlling circumstances may be imposed upon the side bet wagering event.

Any side bet and any underlying game technology may be used in combination with the gaming system described herein. By way of a non-limiting example, any cards, including those which are not a WEDGE event outcome, may be designated as the Progressive Jackpot winning event, of course still using the specially marked cards in the combination of symbols. For an extreme example, the 2 of Hearts, 4 of Spades and 7 of Clubs (with at least one specially marked card) could be used as the Jackpot event, with or without specific ordering. For example, in the normal and preferred play of the game with blackjack, the same-suited Ace and Queen must be in the same hand and the King of Spades in another hand (using 6 or 8 decks with two decks being specially marked). In the extreme example, there would still be 6 or 8 decks, but if no specific ordering is required (i.e., the designated 2, 4 and 7 with special markings), the appearance of the designated 2, 4 and 7 with special markings (e.g., 2 and 4 in one hand, the 7 in the other; the 2 and 7 in one hand and the 4 in the other, or the 4 and 7 in one hand and the 2 in the other) can produce similar high odds, with only one set of the designated 2, 4 and 7 with special markings, or one set and a partial set (e.g., one 1, two 4's and 2 sevens).

The control of the special symbols in the electronic format may be adjusted and controlled to provide other elements into the outcome determinations. For example, rather than providing a simulated 8 decks with exactly 6 or 9 of the specific ranked cards (e.g., A, K and Q) virtually marked, the specially marked symbols may be randomly assigned to virtual cards, such that (using an 8-deck set as an example, with 416 virtual cards), the random symbols may be provided to any displayed card at a frequency of 6/416 times or 9/416 times. When all three of any cards, in any order or arrangement have the three special symbols, a bonus payment on the side bet of at least $50.00 may be paid. At least $2.00 may be paid for any single specially marked cards. When two such random specially marked cards appear, a special bonus of at least $20.00 may be paid. This again increases the rate of frequency of winning events and increases the volatility of the wager.

Other descriptions may include that an aspect of the technology is to provide a progressive side bet for these games where both the side bet has interest-maintaining frequency and value and the jackpot can rise above $1 million wagering units.

The underlying play is similar to Acey-Deucey. A "SPREAD" is created using two playing cards in a Spread Hand (which is a standard two-card hand dealt in the game) and one or two additional cards normally dealt in play of the game are used to determine if those one or two cards have "wedged" between the two playing cards forming the SPREAD.

In Blackjack, the Player Hand must be wagered on as the Spread Hand and the Dealer hand up card is the sole wedge card. In Baccarat, either hand may be wagered on (or both) and the two cards in the opposed hand are used as Wedge cards, preferably requiring both Wedge cards to fall within the SPREAD.

A basic example is where the Spread Hand is dealt a 2 and a 7, creating a spread between them of four cards (a 3, 4, 5 and 6 can wedge between those cards). The third card (or third and fourth card in standard baccarat) must fall within the SPREAD. A paytable is used that offers attractive odds for successful WEDGE events.

For example, in Blackjack, with a SPREAD of seven (e.g., 2 and a ten-value card, all ten value cards being equal in count, so that 10, J, Q and K create the same SPREAD and a Queen does not Wedge between a King and Ten), the odds paid out are 1:1. The odds vary down to a SPREAD of one in Blackjack to 10:1 to 15:1. These payouts are in addition to the Potential Progressive Jackpot payout discussed later.

All pairs and adjacent card ranks (e.g., 2-3, 5-6, 9-10, 9-K [as 10-King are equal], and all Blackjacks are dead hands for the side bet as there is no SPREAD.

In Baccarat, the same principle exists. If the wager is made on the Banker Hand (there is no commission or possible difference in frequency between the Player and Banker hands in this wager), the best format is to require that BOTH Player hand cards fall within the SPREAD created by the Banker hand cards. There is flexibility in the event outcomes so that even higher odds can be paid on non-jackpot events. It is possible to have the wager allow for only one of the two opposing hand cards to Wedge within the SPREAD, but this leads to much lower payout odds, e.g., no more than 2:1, 3:1 or 4:1 on any event.

Odds for a 2-Card SPREAD win (e.g., Banker Hand having an Ace and 4, and the player hand having a 2 and 3) can be 50:1 or higher. Even a 2-10 initial hand can pay 2:1 or 3:1 for a two card Wedge result. This volatility and high odds are very attractive.

Your Mix-and-Match games can fit into these. An important security aspect, however, in your 3-Card Blackjack is that the first two cards must be positioned in a 1st END position and a 2nd END position to define the SPREAD. This is because the player cannot be allowed to create the SPREAD himself. It destroys the odds.

Your 3-Card Baccarat works much better, as the single card is used as the WEDGE card against the SPREAD created by the opposed 2-card hand. The side bet would be played exactly the same as the Blackjack version.

This invention enables achievement of a previously is the technically difficult outcome, developing a large progressive jackpot resolved before play of a game, with only 3 or 4 playing cards exposed. Probabilities in 3-Card events (two player cards and 1 dealer up-card), which is why Three-Card Poker® games have a maximum of 40-1 payout. Even with a positional requirement and same-suited requirement (e.g., A-Q of spades in player hand and King of Spades as the dealer up-card), the frequency is still about 1/10,000, so the jackpot would average about $10,000 without seeding). In the 2-card Wedge for baccarat, the frequency is still about 1/75,000 which does not achieve the industry targeted jackpot levels of at least one million.

The Progressive event preferably will be played with a 6-deck or 8-deck shoe or playing set of cards, although with a single marked set of A-K-Q, 3 or 4 decks may be used, with a similar jackpot frequency and underlying game payout. A continuous shuffler is preferred, as will be explained later. A specific set of SPREAD cards is determined, e.g., the A-Q of Spades in Blackjack (or the Ace-3 of Hearts, the single suit doesn't matter), and some, but less than all of those two cards (and the prefect WEDGE card, such as the King of Spades or 2 of Hearts) have a special jackpot bonus marking on them. Optimum play in a six-deck set of cards appears to be three of each of the cards having the special marking. When the Jackpot SPREAD (e.g., A-Q of Spades) appears AND the perfect Wedge card appears, the jackpot will be paid out as follows:

| | |
|---|---|
| A-K-Q with three specially marked cards | 100% of the Progressive jackpot |
| A-K-Q with two specially marked cards | 15% of the Progressive jackpot |
| A-K-Q with one specially marked card | 5-10% of the Progressive jackpot |

The continuous shuffler prevents exhaustion of any one of the cards and even avoids diminishing numbers of those cards. If there is no continuous shuffler, markers or a panel indicating remaining numbers of the specially marked cards should be provided. When any one card is exhausted, the entire set of cards must be shuffled.

BACCARAT PROGRESSIVE PLAY With Single Suit Only in Progressive Win

Using the two-cards in each hand and requiring the two WEDGE cards to fall within the SPREAD of the other hand, the same specialty marked decks may be used. The Progressive hands will now be A-J of Spades, with the K-Q of spades filling the SPREAD, or A-4 of hearts, with the 2-3 of Hearts filling the SPREAD. Again, the payouts on the Progressive could be:

| | |
|---|---|
| A-K-Q-J with three specially marked cards | 100% of the Progressive jackpot |
| A-K-Q-J with two specially marked cards | 15% of the Progressive jackpot |
| A-K-Q-J with one specially marked card | 5-10% of the Progressive jackpot |

Again, a continuous shuffler is desirable. Because four cards are used, the same type of deck (e.g., with only the A-K-Qs having the special markings) may be used and the occurrence of the A-J in one hand, and the K-Q in the other hand with only three or even two specially marked cards may determine the maximum progressive payout.

The use of this format with electronic, random number generated cards (on the internet or electronic gaming machines or electronic gaming tables) works perfectly as each round of play will begin with a new, randomized 6-deck or 8-deck set of cards, and no significant cards are exhausted hand-to-hand.

CONTROL VARIABLES With Single Suit Only in Progressive Win

There are many event outcome controls that can be used to adjust the House Advantage.

In Blackjack, it is desirable to have 10-J-Q-K of equal 10-value. They may be used in poker style ranks where 10<J<Q<K, but then the odds on the other payouts will accordingly be lowered, in some cases significantly. All blackjacks are therefore considered adjacent cards and although the player wins the blackjack, the side bet is over. This will also allow the tables to continue paying 3:2 on blackjacks, while many are shifting to 6:5. The odds may be varied significantly, with payout odds on a single card SPREAD (e.g., 2-4) allowable between 8:1 and 15:1, while still offering a house advantage of 17% to 8.5%, respectively along with other changes in odds. SUITS DO NOT MATTER IN THE wedge OUTCOMES FOR THE SIDE BET, EXCEPT FOR THE SINGLE (MAY HAVE MULTIPLE, BUT THAT COMPLICATES MARKING AND READING ETC.) SPECIFIC SPREAD AND WEDGE FOR THE JACKPOT.

In Baccarat, the 10-J-Q-K are equal zero-value cards, keeping the reading of the cards the same. Therefore, again, A-K, A-Q, A-J, A-10 and A-2 combinations are "dead" hands for the side bet. It is preferred to require a 2-rank SPREAD as a minimum (e.g., 2-5) rather than allowing a 1-rank SPREAD minimum (e.g., 2-4), but both may be used, with the 1-rank SPREAD requiring a pair for a winning outcome.

The use of the same three marked cards (e.g., some but less than all of the A-K-Q or A-2-3) in the four-card Progressive Jackpot hand keeps the frequency in the 4 million or 20 million to 1 range. By changing it to four specially marked bonus cards for 100% payout, the frequency can exceed 100 million to 1, which is too infrequent. However, the payout odds could be adjusted to

| | |
|---|---|
| A-K-Q-J with four specially marked cards | 100% of the Progressive jackpot |
| A-K-Q-J with three specially marked cards | 30% of the Progressive jackpot |
| A-K-Q-J with two specially marked cards | 15% of the Progressive jackpot |
| A-K-Q-J with one specially marked card | 5-10% of the Progressive jackpot |

This will keep the frequency of Jackpot payouts high enough to show significant bonus activity in the game. The odds on the non-Jackpot side bet events can also be adjusted.

Again, without a continuous shuffler or electronic random number generation, an electronic panel or manual markers showing remaining critical cards should be used.

The partial exhaustion of critical cards will not have as critical an impact on the desirability of the Progressive wager for a number of reasons. There are still attractive partial jackpot events with fewer specially marked cards, and as long as there are specially marked bonus cards, exhaustion of other cards against shifts the richness or probability of the remaining specially marked bonus cards higher.

BACCARAT PLAY USING SPREAD HAND WITH 2-CARDS IN WEDGE HAND—Both Wedge Cards should fill the SPREAD

| SPREAD | PAYOUT ODDS |
|---|---|
| 6-7 | 0:1 to 4:1 |
| 4-5 | 0:1 to 8:1 |
| 3 | 4:1 to 12:1 |
| 2 | 5:1 to 20:1 |
| 1 | If Pairs allowed to fill - 10:1 to 80:1 |

| | |
|---|---|
| A-K-Q-J with three specially marked cards | 100% of the Progressive jackpot |
| A-K-Q-J with two specially marked cards | 15% of the Progressive jackpot |
| A-K-Q-J with one specially marked card | 5-10% of the Progressive jackpot |

As noted, the underlying play of the 3-card event or 4-card event is preferably the Spread and Wedge event in blackjack or baccarat, respectively. In less preferred embodiments, the 3-card event may be a three-card poker paytable and the 4-card event may be a four-card poker paytable, again with the specially marked cards determining the progressive jackpot outcome, based on position, order, timing and frequency of occurrence of the special markings and the specific ranks and suits of cards, as described above.

While this invention is described in terms of preferred embodiments, there are alterations, permutations, and equivalents that fall within the scope of the invention. It should also be noted that there are many alternative ways of implementing the present invention. It is therefore intended that the invention not be limited to the preferred embodiments described herein, but instead that the invention should be interpreted as including all such alterations, permutations, and equivalents as fall within the true spirit and scope of the present invention.

This gaming table system may be networked with other game systems contributing to a progressive jackpot, preferably game systems having a probability of a winning outcome within ±10 percent of the probability of the present system, at least when the first random physical playing cards are delivered. Such systems could be purely electronic table games (no physical playing cards), electronic gaming machines (e.g., electronic blackjack on a networked video gaming machine), multiplayer platform banks of gaming elements, and on-line gaming. Such networking and more detailed descriptions of those separate venues are described in the related applications data section which references have been incorporated by reference, herein.

The gaming system may enable enhancement of wagering outcomes comprising: a) a gaming table having a game play surface; b) a first processor; c) a player input control at a player position, the player input control in communication with the first processor; and d) a random number generator in communication with the first processor; wherein the game play surface at the player position has light elements that are at the player position, and there is a power source in communication with the light elements; the first processor being configured, in response to random selections of light elements at the player position, to direct that light elements on the game play surface are randomly lit or unlit. There may again also be light elements in communication with the power source at a dealer card-receiving position and the first processor, in response to random selections of the light elements at the dealer position, is configured to that the light elements at the dealer position are lit.

The gaming system may have a second processor in communication with the gaming table provides a source of random virtual images on the gaming table for delivery of random symbols to the player position for use in a wagering event. These second processors may be at individual gaming tables or may be a central processor dedicated to one or more individual gaming formats as later described herein. In this manner, the light element enabled wagering event can be associated with a single gaming event or all gaming events within a venue. For example, individual playing card positions in card games can be "lit" randomly, individual symbol positions in video slot systems (e.g., 3×3, 3×5 and 5×5 displays) can be "lit" randomly, individual numbers in keno or bingo can be "lit" randomly, as well as random lights or dedicated lights independent of symbols, at player positions and/or at gaming tables. A random number generator can determine frequency of individual lights or composites of lights (e.g., by the template method described herein) that can be used to determine awards or jackpots. These awards may be independent of side bet wagers (e.g., they may act as random awards within a venue at any active player position, contingent upon a player at that position having an active, ongoing wager, for example, but without any special side bet) or may be dependent upon a side bet wager or a progressive jackpot side bet wager. The frequency and contribution, house hold and the like can be determined by the amount of awards for different events and the frequency set by the RNG (random number generator. For events where there is no wager contribution or even no additional wager (such as in a scatter award, where the occurrence of lights or multiple lights or color combinations of light elements lit at individual positions can determine the amount of awards), awards can be modest but attractive, such as $1.00, $5.00, $10.00, $25.00, $50.00, $100.00 and more. Where there are side bets required for participation in the light element-based awards, the amount of the awards and/or the frequency of the awards can be increased. Similarly in a progressive side bet event, the parameters exercised through the RNG can determine frequency and amounts of awards, and house advantages can be controlled easily. This unique system offers controls over payment that can be totally independent of wagering events or bet ties to wagering events and outcomes as with the special games discussed herein. The size of the awards can be tied to game events to again make the award sizes either larger, smaller, more frequent or less frequent, as desired. For example, with any blackjack and one lit player position light, the blackjack payout may be in a range from a 2× multiplier up to a portion of a progressive jackpot, and with two lights lit at the player position with a blackjack, the blackjack may be in a range of from a 5× multiplier up to a 100% progressive jackpot award.

The lights may be used with the Spread and Wedge bet described above, in place of specially marked cards, to produce higher progressive jackpots. Again, however, by altering the frequency of the random lighting at player positions, frequency and size of winning outcomes can be controlled and adjusted at the designers choice. For example, with an individual lit light frequency of 1/416, an eight deck shoe with a single set of three marked cards can be approximated. With a lit light frequency of 1/156, *a* six deck shoe with two sets of three marked cards can be approximated. With 1/78 lit light frequency, a six deck shoe with 4 sets of three marked cards is approximated. In poker, bingo, keno, roulette, craps and other table games, the frequency of lit lighting can be controlled by the first processor to balance frequency of hits and size of awards independent of underlying game wagering event outcomes or tying the size and frequency to the underlying wagering game event outcomes.

The gaming system may have a second processor in communication with the gaming table provides a source of random virtual images on the gaming table for delivery of random symbols to the dealer position for use in a wagering event. The gaming system may have a source of random virtual symbols is associated with a game processor providing a first set of symbols for use in a first wagering format selected from the group consisting of virtual playing card wagering events, column and row video virtual slot wagering events, virtual roulette wagering events, virtual keno wagering events, virtual dice wagering events, and virtual bingo wagering events. The system may also be provided on physical gaming table wagering events.

The gaming system may enable and be configured to provide a system with communication between the first processor and multiple different wagering events selected from the group consisting of virtual playing card wagering events, column and row video virtual slot wagering events, virtual roulette wagering events, virtual keno wagering events, and virtual bingo wagering events, virtual dice wagering events, and the first processor randomly selects lights to be lit at each of the gaming tables having the multiple different wagering events.

The gaming system may have each gaming table is configured to perform multiple ones of the multiple different wagering events from a single player input terminal at the each gaming table.

The gaming system may have each player position have a player input terminal having a dedicated input function for wagering an amount into a progressive jackpot and the first processor executes software to manage the progressive jackpot by accumulating at least portions of the amounts wagered into the progressive jackpot and awarding at least portions of the progressive jackpot based upon random lighting of lights at the player position and/or the dealer position.

A method of performing a wagering event during a wagering event on a gaming system as described herein could include:

a) the player position providing a wager that includes a wager against a paytable, outcomes of the wager against the paytable being determined at least in part by whether or not the first processor has randomly caused light elements at the player position to be lit;

b) the processor making a random determination as to whether lights at the card-receiving position are to be lit or not lit.

The multiple random virtual symbols may be provided by a second processor to individual player positions at the game table and the light elements are associated with individual symbols as a distinct characterization of the random individual symbols used in determining wagering event outcomes.

Again, physical wagering event implements (physical playing cards, reel slots machines, keno boards, keno tickets, dice, roulette wheels, physical bingo sheets, etc.) may be used with the lighting being distally controlled, or individual cards, tickets, sheets, displayed on a view board where the random light element events are separately displayed.

The mathematical impact of the secondary random number generation cannot be overemphasized, as that impact can be in multiple orders of magnitude in providing bonus effects. Some examples of the degree of this impact are detailed below.

In blackjack, using a single playing card deck and identifying three specific playing cards (e.g., 6 of spades, 7 of spades and 8 of spades, and identifying their distributional order (8S as dealers up card, and the 6S and 7S as the player's up-card, the lowest frequency type of event is defined. The probability of that event occurring is (as the hand is dealt), 1/26 (for either the 6S or 7S being first dealt to the player), 1/51 for the 8S to the dealer, and 1/50 for the 7S or 6S being dealt to the player. That is a frequency of 1/66,300 occurrences in dealing a blackjack game. In using the secondary random number generator frequencies of 70% no indicator from among 1-3 lights or numbers, 20% one light or number 1 indicated, 8% two lights or number 2 being indicated, and 2% three lights of the number three being indicated, looking only at the specially marked 6S, 7S and 8S event, the probabilities are altered by a factor of 50 (5,000%) for the maximum payout. Corresponding intermediate payouts for the single occurrence of a bonused (by the secondary random number generated display) are similarly decreases by 1200% for two cards from 6S, 7S and 8S, and over 200% for the single light or number one display. More importantly, the potential maximum payout at 100% return to players for the maximum payout (the described lowest frequency event) would change from 66.300:1 to 3,315,000 to one, thereby offering the potential for a real million dollar progressive payout from a single $1.00 side bet on the progressive jackpot, with the house still retaining a workable profit margin.

In baccarat, the impact is even more dramatic, using the 6S, 3S in the banker hand and the 5S, 4S in the player hand as the lowest frequency event. With a single deck, the frequency of that occurrence would be (dealing out single cards, one at a time) 1/26 for the 6S, 1/51 for the 5S, 1/50 for the 3S and 1/49 for the 4S, for a frequency of 1/3,248,700. With a frequency distribution among three numbers (at 70%, 20%, 8% and 2%, again), the lowest frequency event would be 1/162,435,000, and with a four number frequency event (for example of 50% (for no number), 30% for one light or the number 1, 12% for two lights or number 2, 7% for three lights or the number 3 and 1% for four lights or the number four) would enable a potential maximum payout of 11,624,350,000 from a one dollar wager. With a relatively high frequency and still significant odds payouts for the intermediate events with the secondary bonussing and frequent payouts such as 100:1 for the spade tie-9 event described, 25:1 for other same-suited tie-9 events, and 10:1 for all tie-9s, tie-8s and tie-7s (thus increasing the frequency of player activity on the side bet), the maximum payout could be preserved at above 10,000,000:1 from a single dollar side bet. This is an extraordinary amount, rising to lottery level payouts in a casino table playing card game. With conventional progressive jackpots on playing card games (such as the progressive jackpots from Caribbean Stud® poker, four card poker games (where an extra card is provided) and Three card Poker™ games (where two extra cards are provided), jackpots seldom reach more than $250,000 from $1.00 side bets. Thus, an average of about a 4,000% increase in the maximum jackpot bonus is enabled, and a higher occurrence of intermediate payouts is enabled for intermediate hands using the present technology.

Using the above-mentioned template systems of U.S. Pat. Nos. 6,159,096 and 6,117,009 (Yoseloff), the frequency of events can be more precisely controlled. For example, the distribution of templates can be provided so that, on average, with 6-8 player positions at a gaming table, one light or the number 1 will occur on average no fewer than once every round, and the maximum 3 or 4 light or number 3 or 4 event will occur no more than once every four rounds of play (or poker, baccarat or blackjack, for example). These frequencies can be adjusted by programming of the secondary random number generating device so that one light or the number 1 will occur on average no fewer than once every two rounds, and the maximum 3 or 4 light or number 3 or 4 event will occur no more than once every three, four, five or six rounds of play (or poker, baccarat or blackjack, for example).

What is claimed:

1. A gaming system for enabling enhancement of wagering outcomes comprising: a) a gaming table having a game play surface with individual player positions for multiple players in an underlying gaming event; b) a programmable electronic random number generator; c) a player input control at each of the individual player positions; d) a visual display system at each individual player position with at least an area on the visual display dedicated to displaying a secondary random event outcome provided by the programmable electronic random number generator for each of the multiple player positions; and e) the random number generator configured to control display on the display system of at least three differently weighted individual player position secondary random outcomes for each player position as determined by the random number generator; wherein the display of individual player position secondary random outcomes is always locked in after a wager has been placed the underlying gaming event at one of the multiple player positions and before disclosure of a final outcome in the underlying gaming event.

2. The gaming system of claim 1 wherein the gaming system is configured so that after at least one wager has been locked in at a player position and before playing cards are viewed at each of the individual player positions, the secondary random outcome for the player position is indicated and locked into the display system for a round of play of an underlying primary wagering event at the gaming table.

3. The gaming system of claim 2 wherein there is a visual display on the gaming table that consists essentially of a separate display element that indicates only a secondary random outcome at a dealer card-receiving position.

4. The gaming system of claim 2 wherein a source of random standard ranks and suits as physical playing cards is available for use in an underlying physical playing card wagering event to be performed on the game play surface, and the system is configured so that secondary random events are displayed only prior to player positions viewing the physical playing cards, with consisting of between 2-10 differently weighted secondary random events being available for display from the programmable electronic random number generator, and the display of individual player position secondary random outcomes is provided on the visual display on the gaming table at each individual player position and the visual display on the gaming table at each individual player position consist essentially of a separate display element that indicates only a secondary random outcome at a dealer card-receiving position.

5. The gaming system of claim 4 wherein the player input control includes a physical or an electronic wagering system on a side bet event accompanying the underlying physical playing card wagering event.

6. The gaming system of claim 5 wherein player the input control is configured to communicate wagering input through the wagering system at the player position to a first processor and the first processor is configured to maintain an accounting function on a progressive jackpot event resolved at least in part by: random playing cards provided to the individual player position from the source of random physical playing cards and the random secondary outcome indicated at each individual player position only after a wager has been placed at the individual player position.

7. The gaming system of claim 5 wherein the player input control communicates wagering input at the player position to a first processor and the first processor is configured to maintain an accounting function on a progressive jackpot event resolved at least in part by displays of the random secondary outcome on the display elements on the game play surface.

8. The gaming system of claim 5 wherein the individual player positions each have a player input terminal having a dedicated input function for wagering an amount into a progressive jackpot and a first processor executes software to manage the progressive jackpot by accumulating at least portions of the amounts wagered into the progressive jackpot; such that awards of at least portions of the progressive jackpot may be awarded based upon the individual secondary random events at each of the player positions.

9. The gaming system of claim 2 wherein the individual player positions each have a player input terminal having a dedicated input function for wagering an amount into a progressive jackpot and a first processor executes software to manage the progressive jackpot by accumulating at least portions of the amounts wagered into the progressive jackpot; such that awards of at least portions of the progressive jackpot may be awarded based upon the individual secondary random events at each of the player positions position, with consisting of between 2-10 differently weighted secondary random events being available from the programmable electronic random number generator.

10. The gaming system of claim 1 wherein there is a first processor in communication with the gaming table and provides a source of random virtual images on the gaming table for delivery of random symbols to the player position for use in a primary wagering event on the underlying wagering game.

11. The gaming system of claim 1 wherein the individual player positions each have a player input terminal having a dedicated input function for wagering an amount into a progressive jackpot and a first processor executes software to manage the progressive jackpot by accumulating at least portions of the amounts wagered into the progressive jackpot, such that awards of at least portions of the progressive jackpot may be awarded based upon the individual secondary random events at each of the player positions.

12. A method of performing a wagering event during a wagering event on a gaming system according to claim 1 on the game table with multiple individual player positions, individual player positions performing steps comprising: a) the individual player position providing a wager that includes at least one wager on the underlying gaming event or a side bet wagering event against paytable, outcomes of the at least one wager against the paytable being determined at least in part by specific displays occurring on the display element for the individual player position as determined by the random number generator; and b) before conclusion of an underlying primary random wagering event and after the wager against the paytable has been provided, locking the specific displays of the random secondary outcome comprising a virtual image onto the display element until after conclusion of the underlying primary random wagering event.

13. The method of claim 12 wherein multiple random i) virtual symbols or ii) numbers of individual lights are provided by the random number generator to the multiple individual player positions at the game table and content of i) or ii) act as a distinct characterization changer of: iii) outcomes of the underlying primary random wagering event; iv) a side bet on the underlying primary random wagering event; or v) the random collections of symbols comprising symbols used in determining wagering event outcomes in the underlying primary random wagering event.

14. A method according to claim 13 comprising performing a progressive wagering event during the underlying primary random wagering event by apportioning a side bet progressive wager among house advantage, player non-progressive events, and a progressive jackpot; and using i) and ii) in determining amounts awarded in the progressive wagering event.

15. The method of claim 14 wherein i) and ii) act as equivalent to virtual special marking on physical playing cards used in the underlying primary random wagering event selected from the group of blackjack games, baccarat games, and poker games.

16. The method of claim 13 wherein i) and ii) act as an equivalent to virtual special marking on physical playing cards used in the underlying primary random wagering event.

17. The method of claim 12 wherein random i) virtual symbols, ii) numbers of individual lights and/or iii) illuminated symbols are selected by the programmable electronic random number generator for display at individual player positions at the game table, and content of i), ii) and/or iii) act as a distinct characterization of I) outcomes of the underlying primary random wagering event, II) available extra cards, III) available discards and replacements, IV) altered paytables on an underlying wagering event, V) altered paytables on a side bet, VI) altered paytables on a progressive jackpot or VII) entry into a bonus event on the underlying primary random wagering event.

18. The method of claim 12 wherein the visual display system at each individual player position provides only the display of individual player position secondary random outcomes at each individual player position and the visual display on the gaming table at each individual player position consist essentially of a separate display element that indicates only a secondary random outcome at the individual player positions.

19. The gaming system of claim 1 wherein random i) virtual symbols, ii) quantities of lights and/or iii) illuminated symbols are selected by the programmable electronic random number generator for display at individual player positions at the game table and content of i), ii) and/or iii) act as a distinct characterization of an outcome or event selected from the group consisting of: I) outcomes of the underlying primary random wagering event; II) available extra cards; III) available discards and replacements; IV) altered paytables on an underlying wagering event; V) altered paytables on a side bet; VI) altered paytables on a progressive jackpot; and VII) entry into a bonus event on the underlying primary random wagering event.

20. A gaming system for enabling enhancement of wagering outcomes comprising: a) a gaming table having a game play surface with individual player positions for multiple players; b) a first processor; c) a player input control at each individual player position, the player input control being in communication with the first processor; and d) a random number generator in communication with the first processor; wherein the game play surface at each individual player position has a display element that only identifies individual secondary random event outcomes for a single game event at each player position selected from at least three differently weighted secondary random outcomes, and there is a power source in communication with the display element; the first processor being configured, in response to random selections of secondary random outcome displays at the display element for the individual player position, to direct that the display element displays the random secondary outcome for respective player positions only after a wager has been placed at one of the multiple player positions.

* * * * *